US006966696B1

(12) United States Patent
Curry et al.

(10) Patent No.: US 6,966,696 B1
(45) Date of Patent: Nov. 22, 2005

(54) METHODS FOR LAUNDERING DELICATE GARMENTS IN A WASHING MACHINE

(75) Inventors: John Downing Curry, Oxford, OH (US); Freddy Arthur Barnabas, West Chester, OH (US); Jack A. Doty, Greenhills, OH (US); Thomas Charles Hortel, Cincinnati, OH (US); Michelle Frances Mellea, Hamilton, OH (US); Corey Elizabeth Schmidt, Highland Heights, KY (US); Corey Sue Snyder, Cincinnati, OH (US); Todd Michael Wernicke, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/830,250

(22) PCT Filed: Oct. 22, 1999

(86) PCT No.: PCT/US99/24937

§ 371 (c)(1),
(2), (4) Date: Sep. 13, 2001

(87) PCT Pub. No.: WO00/24958

PCT Pub. Date: May 4, 2000

Related U.S. Application Data

(60) Provisional application No. 60/105,539, filed on Oct. 24, 1998, provisional application No. 60/157,399, filed on Oct. 1, 1999.

(51) Int. Cl.[7] ..... B65D 30/00

(52) U.S. Cl. ..... 383/2; 383/89; 383/117; 68/235 R

(58) Field of Search ..... 383/4, 2, 117, 89; 5/417, 418, 419, 420; 68/235 R

(56) References Cited

U.S. PATENT DOCUMENTS

| | | | | |
|---|---|---|---|---|
| 503,355 | A * | 8/1893 | Phillips | 206/278 |
| 1,385,695 | A * | 7/1921 | MacCormack et al. | 383/92 |
| 3,029,852 | A * | 4/1962 | Taylor | 383/2 |
| 3,906,753 | A | 9/1975 | Siegfried | |
| 4,010,785 | A * | 3/1977 | Patik | 383/87 |
| 4,102,825 | A | 7/1978 | Murata et al. | |
| 4,195,378 | A * | 4/1980 | Parker | 5/419 |
| 4,267,077 | A | 5/1981 | Niimi et al. | |
| 4,336,024 | A | 6/1982 | Rossard et al. | |
| 4,421,657 | A | 12/1983 | Allen et al. | |
| 4,662,517 | A * | 5/1987 | Wirth | 206/388 |
| 4,714,479 | A | 12/1987 | Wilsberg | |
| 4,746,455 | A | 5/1988 | Matsuda et al. | |
| 4,750,907 | A | 6/1988 | Wilsberg | |
| 4,781,041 | A | 11/1988 | Fowler | |
| 4,846,982 | A | 7/1989 | Madore et al. | |
| 4,911,852 | A | 3/1990 | Coffindaffer et al. | |

(Continued)

FOREIGN PATENT DOCUMENTS

DE 25 47 588 4/1977

(Continued)

*Primary Examiner*—Jes F. Pascua
(74) *Attorney, Agent, or Firm*—Jeffrey V. Bamber; Julia A. Glazer

(57) ABSTRACT

A product and process for laundering delicate or dry-clean only garments in a conventional home washing machine. The process represents a home version of the commercial wet-cleaning processes for cleaning of delicate garments. The product may comprise a liquid cleaning composition, a wash pretreatment composition, a wash pretreatment applicator, an apparatus for dispensing a rinse cycle conditioner and a flexible wrap container within which the garments are contained during washing.

10 Claims, 14 Drawing Sheets

U.S. PATENT DOCUMENTS

| | | | | | |
|---|---|---|---|---|---|
| 4,978,462 | A | | 12/1990 | Sheppard | |
| 4,978,471 | A | | 12/1990 | Starch | |
| 4,989,995 | A | | 2/1991 | Rubenstein et al. | |
| 5,026,489 | A | | 6/1991 | Snow et al. | |
| 5,057,240 | A | | 10/1991 | Madore et al. | |
| 5,091,105 | A | | 2/1992 | Madore et al. | |
| 5,110,506 | A | | 5/1992 | Ciallella | |
| 5,114,706 | A | | 5/1992 | DuVel | |
| 5,199,120 | A | * | 4/1993 | Holmes | 5/419 |
| 5,254,269 | A | | 10/1993 | Taylor et al. | |
| 5,288,431 | A | | 2/1994 | Huber et al. | |
| 5,354,491 | A | | 10/1994 | Bjorkquist et al. | |
| 5,401,101 | A | * | 3/1995 | Wang | 383/6 |
| 5,536,493 | A | | 7/1996 | Dubief | |
| 5,614,484 | A | | 3/1997 | Panandiker | |
| 5,648,327 | A | | 7/1997 | Smerznak et al. | |
| 5,661,988 | A | | 9/1997 | Oh et al. | |
| 5,674,832 | A | | 10/1997 | Keys | |
| 5,681,355 | A | | 10/1997 | Davis et al. | |
| 5,681,808 | A | | 10/1997 | Kobayashi et al. | |
| 5,687,591 | A | | 11/1997 | Siklosi et al. | |
| 5,714,446 | A | | 2/1998 | Bartz et al. | |
| 5,723,426 | A | | 3/1998 | Zhen et al. | |
| 5,747,443 | A | | 5/1998 | Wahl et al. | |
| 5,753,079 | A | | 5/1998 | Jenny et al. | |
| 5,759,208 | A | | 6/1998 | Zhen et al. | |
| 5,759,990 | A | | 6/1998 | Wahl et al. | |
| 5,762,647 | A | | 6/1998 | Brown et al. | |
| 5,789,368 | A | | 8/1998 | You et al. | |
| 5,824,635 | A | | 10/1998 | Keys | |
| 5,830,845 | A | | 11/1998 | Trinh et al. | |
| 5,861,370 | A | | 1/1999 | Trinh et al. | |
| 5,877,145 | A | | 3/1999 | Wahl et al. | |
| 5,977,055 | A | | 11/1999 | Trinh et al. | |
| 6,040,286 | A | | 3/2000 | Huff | |
| 6,053,952 | A | | 4/2000 | Kaiser | |
| 6,061,849 | A | * | 5/2000 | Seals | 5/417 |
| 6,139,587 | A | | 10/2000 | Nair et al. | |
| 6,223,367 | B1 | * | 5/2001 | French et al. | 5/419 |
| 6,323,172 | B1 | | 11/2001 | Trinh et al. | |
| 6,335,315 | B1 | | 1/2002 | Trinh et al. | |
| 6,369,025 | B1 | | 4/2002 | Trinh et al. | |
| 6,478,464 | B1 | * | 11/2002 | Miller | 383/76 |
| 6,722,542 | B2 | * | 4/2004 | McMurray et al. | 224/563 |
| 2003/0008799 | A1 | | 1/2003 | Barnabas et al. | |

FOREIGN PATENT DOCUMENTS

| | | | | | |
|---|---|---|---|---|---|
| DE | DT2547588 | A1 | * | 4/1977 | 383/71 |
| DE | 28 32 679 | | | 2/1979 | |
| DE | 34 11 084 | | | 1/1986 | |
| DE | 286179 | A5 | | 1/1991 | |
| EP | 0 387 658 | | | 9/1990 | |
| EP | 0 394 689 | | | 10/1990 | |
| EP | 0 630 855 | | | 12/1994 | |
| EP | 0 342 834 | B1 | | 1/1995 | |
| EP | 1 018 541 | | | 7/2000 | |
| GB | 2 054 635 | | | 2/1981 | |
| GB | 2 078 670 | | | 1/1982 | |
| GB | 2 245 281 | A | | 1/1992 | |
| GB | 2 302 553 | | | 1/1997 | |
| GB | 2 330 148 | A | | 4/1999 | |
| JP | 09-242905 | | | 9/1986 | |
| JP | 08-029757 | | | 6/1987 | |
| JP | 02-180296 | | | 7/1990 | |
| JP | 04-036394 | | | 2/1992 | |
| JP | 04-144592 | | | 5/1992 | |
| JP | 06-293499 | | | 1/1993 | |
| JP | 05-293290 | | | 11/1993 | |
| JP | 07-080184 | | | 3/1995 | |
| JP | 07-124377 | | | 5/1995 | |
| JP | 07-289778 | | | 11/1995 | |
| JP | 07-328279 | | | 12/1995 | |
| JP | 08-098986 | | | 4/1996 | |
| JP | 08-196778 | | | 8/1996 | |
| JP | 09-056973 | | | 3/1997 | |
| JP | 09-067594 | | | 3/1997 | |
| JP | 09-075580 | | | 3/1997 | |
| JP | 09-105077 | | | 4/1997 | |
| JP | 09-131489 | | | 5/1997 | |
| JP | 09-140988 | | | 6/1997 | |
| JP | 09-201487 | | | 8/1997 | |
| JP | 09-215892 | | | 8/1997 | |
| JP | 09-220394 | | | 8/1997 | |
| JP | 09-234294 | | | 9/1997 | |
| JP | 09-271597 | | | 10/1997 | |
| JP | 10-005487 | | | 1/1998 | |
| JP | 10-015282 | | | 1/1998 | |
| JP | 10-015283 | | | 1/1998 | |
| JP | 10-015284 | | | 1/1998 | |
| JP | 10-015285 | | | 1/1998 | |
| JP | 10-028790 | | | 2/1998 | |
| JP | 10-057667 | | | 3/1998 | |
| JP | 10-060480 | | | 3/1998 | |
| JP | 10-060483 | | | 3/1998 | |
| JP | 10-071295 | | | 3/1998 | |
| JP | 10-118386 | | | 5/1998 | |
| JP | 10-137486 | | | 5/1998 | |
| JP | 10-151292 | | | 6/1998 | |
| JP | 10-158693 | | | 6/1998 | |
| JP | 10-158962 | | | 6/1998 | |
| JP | 10-179499 | | | 7/1998 | |
| JP | 10-201992 | | | 8/1998 | |
| JP | 10-235074 | | | 9/1998 | |
| JP | 10-249090 | | | 9/1998 | |
| JP | 10-251962 | | | 9/1998 | |
| JP | 10-305188 | | | 11/1998 | |
| JP | 11-004992 | | | 1/1999 | |
| JP | 08-218855 | | | 3/1999 | |
| JP | 11-057278 | | | 3/1999 | |
| JP | 11-076677 | | | 3/1999 | |
| JP | 11-123297 | | | 5/1999 | |
| JP | 11-156083 | | | 6/1999 | |
| JP | 11-169587 | | | 6/1999 | |
| JP | 11-172592 | | | 6/1999 | |
| JP | 11-197387 | | | 7/1999 | |
| JP | 11-207079 | | | 8/1999 | |
| JP | 11-253689 | | | 9/1999 | |
| JP | 11-300079 | | | 11/1999 | |
| JP | 11-300080 | | | 11/1999 | |
| JP | 11-319369 | | | 11/1999 | |
| JP | 11-333195 | | | 12/1999 | |
| JP | 11-347284 | | | 12/1999 | |
| JP | 00-14965 | | | 1/2000 | |
| JP | 00-024376 | | | 1/2000 | |
| JP | 00-070587 | | | 3/2000 | |
| JP | 00-107486 | | | 4/2000 | |
| JP | 00-116981 | | | 4/2000 | |
| JP | 00-116983 | | | 4/2000 | |
| WO | WO 97/00992 | | | 1/1997 | |
| WO | WO 97/03169 | | | 1/1997 | |
| WO | WO 97/07278 | | | 2/1997 | |
| WO | WO 97/12019 | | | 4/1997 | |
| WO | WO 97/12022 | | | 4/1997 | |
| WO | WO 97/12027 | | | 4/1997 | |
| WO | WO 97/27354 | | | 7/1997 | |
| WO | WO 97/41291 | | | 11/1997 | |
| WO | WO 98/04770 | | | 2/1998 | |
| WO | WO 99/12988 | | | 3/1999 | |
| WO | WO 99/18177 | | | 4/1999 | |
| WO | WO 00/24958 | | | 4/2000 | |
| WO | WO 00/24857 | | | 5/2000 | |
| WO | WO 00/24860 | | | 5/2000 | |

* cited by examiner

METHODS FOR LAUNDERING DELICATE GARMENTS IN A WASHING MACHINE

This application claims the benefit of U.S. Provisional Application Nos. 60/105,539, filed Oct. 24, 1998 and 60/157,399, filed Oct. 1, 1999.

TECHNICAL FIELD

The present invention relates to products and processes for laundering delicate or dry-clean only garments in a conventional home washing machine.

BACKGROUND OF THE INVENTION

By definition, the term "dry cleaning" has been used to describe processes for cleaning textiles using non-aqueous solvents. Dry cleaning is an old art with solvent cleaning first being recorded in the United Kingdom in the 1860s. Typically, dry cleaning processes are used with delicate fabrics such as wool and silk which are subject to shrinkage in aqueous laundering baths, or which are judged to be too valuable or delicate to be subjected to aqueous laundering processes. Such garments usually have a tag affixed to them either identifying the garment as "dry clean only" or providing some other appropriate laundering tocsin. For the last fifty years, the most widely-used non-aqueous solvent of choice for commercial dry-cleaning has been perchloroethylene.

While perchloroethylene is superior to the non-aqueous solvents that it replaced, it has several disadvantages. In particular perchloroethylene has been identified as a hazardous air pollutant by the U.S. Environmental Protection Agency and has been long associated with nervous-system and kidney disorders among industrial workers. In 1995, the Environmental Protection Agency classified perchloroethylene as a "probable human carcinogen." Perchloroethylene's potential carcinogenic effects are not limited solely to industrial workers or those who operate perchloroethylene-based dry clean processes: a recent study of commercial dry cleaners in New York revealed that many of these cleaners used such high amounts of perchloroethylene to clean garments, that customers who wore freshly dry-cleaned garments could inhale enough perchloroethylene to incur a slightly increased risk of cancer. As a consequence of the hazardous nature of perchloroethylene, dry cleaning processes utilizing perchloroethylene must be done at commercial establishments. Not only is this both inconvenient and expensive, but it can expose delicate and quite possibly expensive garments to dry-cleaning processes of inconsistent quality and garment care. Many consumers who have taken their goods to a commercial dry-cleaner have reported them being damaged either by excessive shrinking, discoloration or tearing. The use of perchloroethylene in commercial dry-cleaning establishments also tends to leave a "chemical" smell on clothing that consumers find unsatisfactory.

Moreover, while solvent-based dry cleaning processes are quite effective for removing oily soils and stains, they are not optimal for removing particulates such as clay soils or the water-soluble stains such as the sugars commonly found in many fruit drinks and carbonated beverages, and may require special treatment conditions to remove proteinaceous stains.

Given the foregoing, there is a continuing need for a method or process that provides excellent cleaning benefits on a variety of stains and soiling conditions and imparts a "fresh" and "clean" scent to delicate or dry-clean only goods without the use of hazardous or harmful chemicals. Accordingly, it is a feature of the present invention to provide a process for cleaning delicate or dry-clean only garments that uses non-toxic and non-hazardous chemicals to provide superior cleaning benefits on a wide variety of soils and stains. Such a method or process should also be relatively convenient and inexpensive and be without the possible garment damage and adverse "chemical" scent that is sometimes the result of commercial dry-cleaning.

Ideally, particulates and proteinaceous stains, as well as oily soils and stains, are removed from fabrics using detersive ingredients and under operating conditions which are more akin to aqueous laundering processes than to conventional dry cleaning. Such aqueous laundry processes also consistently impart a "freshness" or "clean" scent to fabric, rather than the "chemical" smell that is often found when perchloroethylene or other non-aqueous solvents are used.

Perhaps the most widely practiced aqueous laundering process is that which the consumer performs when she or he immerses a garment into an aqueous laundry detergent solution in a conventional home washing machine. Such a process has long been shown to provide excellent performance for both stain removal and overall garment cleaning and can be performed without using hazardous or toxic chemicals. Moreover, the use of an aqueous laundering process in a conventional washing machine is considerably more convenient and inexpensive than virtually any other laundering method.

Nonetheless, such processes can produce unacceptable results when applied to a broad range of delicate or dry-clean only garments, such as those made from wool. Wool, is made up of a fibers which can interlock with one another by a series of "scales". Generally, these interlocking scales cannot move past one another and as a result wool is a relatively strong textile. However, when wool becomes wet or moistened then the water provides lubrication by which the scales may move past one another in a preferential direction if sufficient force is exerted in that direction; such force may be provided by the agitation experienced in a washing machine. When the fibers move in this preferential direction, then the wool garment shrinks. This shrinkage cannot be undone because these "scales" can only move past one another in a preferred direction. Sufficient force cannot be exerted to move them in the direction opposite to the preferred direction to undo the shrinkage. Thus when the wool garment is removed from the aqueous laundry process, shrinkage has occurred and the garment is irreversibly damaged. Similarly, rayon, when saturated with water, becomes extremely weak and the subsequent agitation and abrasion that it experiences in a typical aqueous laundry process is likely not only to cause severe damage to the garment but also to leave it extremely wrinkled. Similarly, delicate fabrics like silk will not only be severely wrinkled but also may lose their desirable soft feel.

Garments such as silks are also vulnerable not only to the mechanical agitation of a conventional washing machine but are also particularly vulnerable to the typical laundry detergents because such detergents may contain ingredients that are too harsh for such delicate fabrics. It is thus a further benefit of the present invention to provide an aqueous laundering process adapted for use in a conventional washing machine that is not harmful to garments made from fabrics such as wool, rayon, silk, acrylics, triacetates, fine cottons and blends of these aforementioned materials.

A system has been devised in the present invention to provide the traditional cleaning, brightening and freshening benefits of an aqueous laundering process without the deleterious consequences to delicate and dry-clean only fabrics described above. The system uses a flexible, polymer wrap container. When a garment is secured within this container the garment is buffered and cushioned from the force and stress caused by the agitator. The system also uses as a detergent a liquid laundry composition which is modified to be mild on delicate garments. This laundry composition may also be present in the form of a gel, foam, or viscous liquid. To enhance cleaning efficacy on stains, the system may provide an applicator and, optionally a special stain-absorbent pad which the consumer may use to pretreat a stain before it is placed in the washing machine. In addition, the present invention makes use of a rinse cycle conditioner to improve color fidelity, provide antiwrinkling benefits and reduce fabric abrasion as well as providing other fabric care benefits.

When used according to the processes described herein, this system provides a consumer with a convenient, inexpensive, and efficacious way to clean delicate and dry-clean only garments in the home.

SUMMARY OF THE INVENTION

By the present invention, processes and kits for performing these processes have been found by which delicate and dry-clean only garments can be cleaned and freshened in an aqueous laundering process without damaging the garment. An aqueous laundry process performed in a conventional home washing machine is particularly envisioned. Accordingly, the present invention solves the long-standing need for an inexpensive and convenient process of cleaning dry-clean only and other delicate garments in a conventional home washing machine. The process of the present invention provides equal to superior overall cleaning of garments when compared to a commercial dry-cleaning establishment using perchloroethylene but without the use of hazardous chemicals or the deposition of chemical malodors on the garment. The present invention relates to a kit and process for laundering delicate or dry-clean only garments in a conventional home washing machine. The kit comes with a flexible wrap container and instructions for using the container to launder garments in a conventional home washing machine.

The flexible wrap container is designed to contain and protect delicate or dry-clean only clothes from being subjected to the agitation action of a washing machine. The basic part of the flexible wrap container is a flexible rectangular panel constructed of a woven polyester or woven nylon layer. At least two and preferably four snaps are located near the edge of one of the panel's sides. These snaps may be used for attaching the flexible wrap container to another identical flexible wrap container. Attached near the edge of the side directly opposite the side where the snaps are located are one or more straps, each strap being equipped with a pair of fasteners. When the wrap is folded up according to the directions of use, the strap or straps may be tightened around the wrap and one or more fasteners engaged to hold the strap or straps in place so that the bag is secured and will not open up under normal agitation conditions. The instructions provided herein are enclosed with or on a container enclosing the kit. The instructions direct a user to place a garment inside the flexible wrap container and then place the flexible wrap container together with an effective amount of a liquid cleaning composition inside a washing machine.

There is also provided a process for cleaning garments using the kit provided with this invention. This process encompasses placing the fabrics and textiles within the flexible wrap container described above and then placing the flexible wrap container together with an effective amount of a liquid cleaning composition inside a washing machine and then operating the washing machine as prescribed by the manufacturer.

The present invention also provides a wash pretreatment applicator which is used to distribute or spread the wash pretreatment composition across the surface of a stain. The wash pretreatment applicator disclosed by the present invention is a substantially cylindrical tube having an open end and a closed end. The closed end portion of the tube is provided with numerous bristles adapted to apply a cleaning composition to a stain covering a localized area of a delicate or dry-clean only garment. The tube being sized and configured to fit securedly around a human finger with the closed end of the tube position adjacent to the tip of the finger and the open end of the tube positioned adjacent to the second joint of the finger.

The present invention also discloses a preferred embodiment of the flexible wrap container described above. This preferred flexible wrap container additionally comprises a first and second flap attached to the flexible wrap container along the right edge of the panel and along the left edge of the panel, respectively. The flaps may overlap each other to provide increased garment containment during use. Other preferred flexible wrap containers are provided with a tapering top portion to which is attached at least one of the previously described straps. In addition to or in place of the flaps, a flexible fence can be provided along the right and left edges of the flexible wrap container for garment containment.

In this invention it may be desirable for the panel to be a layered material, comprising a core material between a first layer material and a second layer material, the core material being polyester, the first layer material and the second layer material being nylon and the first flap and second flap each constructed from polyester. The first layer material of nylon and the polyester material that forms the flaps are woven in such a way that they are provided with numerous holes.

All percentages, ratios and proportions herein are by weight, unless otherwise specified. All documents cited are, in relevant part, incorporated by reference.

DETAILED DESCRIPTION OF THE INVENTION

Figure 1:
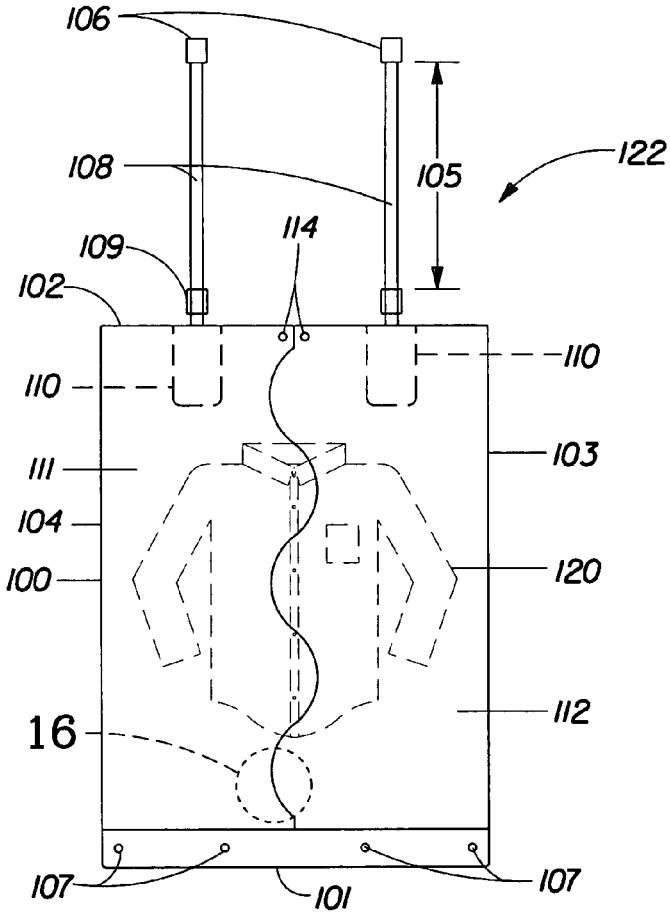
FIG. 1 is a side view illustrating the flexible wrap container 122.

Reference will now be made in detail to the present preferred embodiments of the invention, examples of which are illustrated in the accompanying drawings. In accordance with one aspect of the present invention, a kit is provided which contains the necessary materials to enable a consumer to clean their delicate or dry-clean only garments in a conventional, home washing machine with superior cleaning performance but without significant damage or the adverse effects typically associated with aqueous garment cleaning. At a minimum, the kit includes a liquid cleaning composition specially formulated for treating and cleaning delicate and dry-clean only garments, a rinse cycle conditioner and a flexible wrap container. The kit may also include: a wash pretreatment composition, one or more wash pretreatment applicators, an apparatus for dispensing a rinse cycle conditioner and multiple absorbent stain receiver pads.

The flexible wrap container disclosed by the present invention provides significant benefits over similar devices in use today. In particular, it offers a superior means for securing and closing itself, thereby limiting the chance that garments will spill out of it and be damaged while being laundered in a washing machine. Additionally, the thickness of the flexible wrap container insulates and protects the garment or garments contained therein from the stress and abrasion that may be caused by the agitator and other internal parts of a washing machine. The flexible wrap container further offers an expandability and versatility that is not seen in other such devices: not only is the flexible wrap container larger than competing devices, it has a series of connecting means (e.g. snaps) which allow two identical flexible wrap containers to be snapped together to provide an additional flexible wrap container of twice the original capacity at no extra cost to the consumer. This further enhances the dimension retention benefits of the present invention.

The present invention further provides a wash pretreatment applicator intended to be affixed on a human finger, that is used to spread the wash pretreatment composition over the stained area of a garment. The wash pretreatment applicator is an highly useful tool by which stain removal agent may be distributed over the stained area of a garment with enhanced convenience and efficacy.

When these separate components are taken and used together, the result is an innovative process and a kit for performing that process by which delicate and dry-clean only garments can be cleaned and freshened in an aqueous laundering process without damaging the garments. An aqueous laundry process performed in a conventional home washing machine is particularly envisioned.

Definitions

By "aqueous compositions" herein is meant compositions which comprise a major portion of water.

By "solution" herein is meant a liquid mixture of ingredients. As used herein "solution" does not convey or imply the existence of only a single liquid or solid phase. Nor is it meant to describe a homogenous solvent/solute system.

By "effective amount" herein is meant any amount capable of measurably improving stain removal from a localized area of a garment. In general, this amount may vary quite widely.

By "cleaning" herein is meant the removal of soils and stains from fabrics. By "contact with stained areas" with respect to the wash pretreatment applicator is meant contact which is afforded by the impingement of the soft bristles which comprise the brush means of the device with the one side of the stained area. By "contact with the stained areas" with respect to the absorbent stain receiver pad is meant that the side of the stained area of the fabric opposite the wash pretreatment applicator directly impinges on the receiver and is in close communication therewith.

The components of the devices of this invention and their method of use are described in more detail hereinafter.

Liquid Cleaning Composition and the Wash Pretreatment Composition

Some laundry detergent compositions are too harsh to treat delicate and dry-clean only garments. In particular, detergent ingredients such as certain surfactants, certain enzymes and certain bleaches can cause serious damage (garment discoloration in particular) to delicate and dry-clean only garments. Accordingly, the liquid cleaning compositions of the present invention, should most preferably be substantially free of bleaches and include an enzyme cocktail that is less harsh than the enzymes typically used in a laundry detergent composition. Stated otherwise, the liquid cleaning compositions herein should be formulated so as not to damage fabrics by causing discoloration, abrasion or other adverse effects.

Consequently, while conventional laundry detergents are usually formulated to provide good cleaning on cotton and cotton/polyester blend fabrics, the compositions here must be formulated to also safely and effectively clean and refresh fabrics such as wool, silk, rayon, alpaca fleece, fine cotton and blends of the aforementioned fabrics. In addition, the compositions herein comprise ingredients which are specially selected and formulated to minimize the migration of fugitive dyes from stain sites.

Accordingly, the present invention also includes a wash pretreatment composition. The formulation for the wash pretreatment composition is selected from among the same ingredients and compositional ranges and with an even stricter requirement for fabric mildness as the liquid cleaning composition. The wash pretreatment composition is applied directly to the stained area of the garment by the use of an applicator (described in greater detail herein) after which the stained area of the garment may or may not be rinsed off with water. Alternatively, the liquid cleaning composition may be used as the wash pretreatment composition and no separate wash pretreatment composition is needed.

The liquid cleaning composition is then subsequently mixed with water in a washing machine in the customary fashion to form an aqueous laundry detergent solution suitable for immersion cleaning of garments.

It has now been discovered that when the applicator, the liquid cleaning composition and the wash pretreatment composition are used in the manner described herein, excellent spot and stain removal performance are obtained even though the aforementioned liquid cleaning compositions are specially formulated to be mild and gentle. In addition to the foregoing considerations, the compositions used herein are preferably formulated such that they are easily dispensed and not so adhesive in nature that they render the stain-removal applicator unwieldy or difficult to use. It is understood that the "active adjunct" materials used will vary, depending on the intended end-use of the final composition. The following are intended only to be nonlimiting illustrations of such active adjuncts, more examples of which will readily come to mind of the skilled formulator.

Detersive Surfactants—Surfactants are known to have potentially harsh effects on fabrics. Typically, the compositions herein will comprise from about 3% to about 40%, more preferably from about 10% to about 25%, most preferably from about 15% to about 20%, by weight of detersive surfactants.

Nonlimiting examples of surfactants useful herein include the unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$ –$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants as well as predominantly nonionic surfactant systems are especially useful. Other conventional useful surfactants are listed in standard texts.

Builders—The compositions of the present invention preferably comprise one or more detergent builders or builder systems. When present, the compositions will typically comprise from about 0.01% to about 35%, more preferably from about 1% to about 25%, most preferably from about 2% to about 8% by weight, of detergent builder.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Citrate builders, e.g., citric acid and soluble salts thereof (particularly sodium salt), are polycarboxylate builders of particular importance for the present detergent formulations due to their availability from renewable resources and their biodegradability.

Fatty acids are also important carboxylate builders for the present invention. The fatty acids disclosed herein may contain from about 1 to about 10 ethylene oxide units in the hydrocarbon chain. Preferred are saturated fatty acids containing from about 12 to about 16 carbon atoms.

Suitable saturated fatty acids can be obtained from natural sources such as plant or animal esters (e.g., stripped palm kernel oil, stripped palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids, from about 5:1 to 1:1 (preferably about 3:1) weight ratio mixtures of lauric and myristic acid, mixtures of the above with minor amounts (e.g., 10%–30% of total fatty acid) of oleic acid; and stripped palm kernel fatty acid.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874

Crutchfield et al., issued Oct. 17, 1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Enzmmes—Enzymes can be included in the formulations herein for a wide variety of fabric laundering purposes, including removal of protein-based, carbohydrate-based, or triglyceride-based stains, for the prevention of fugitive dye transfer and for fabric restoration. A suitable enzyme is one which can be applied to the surface of a delicate or dry-clean only garment without causing visible or significant damage. Therefore, the selection of enzymes must be a balance of cleaning efficacy versus mildness and gentleness when applied to delicate or dry-clean only garments. The enzymes to be incorporated include proteases, amylases, mannanase and lipases as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active surfactants, builders and so on. In this respect bacterial or fungal enzymes are preferred, such as bacterial amylases and proteases.

"Detersive Enzymes," as used herein, means any enzyme having a cleaning, stain removing or other-wise beneficial effect in a laundry composition. Enzymes are normally incorporated into detergent or detergent additive compositions at levels sufficient to provide a "cleaning-effective amount." The term "cleaning effective amount" refers to any amount capable of producing a cleaning, stain removal, soil removal, whitening, deodorizing, or freshness improving effect on garments. In practical terms for current commercial preparations, typical amounts are up to about 5 mg by weight, more typically 0.01 mg to 3 mg, of active enzyme per gram of the composition. Stated otherwise, the compositions herein will typically comprise from about 0.001% to about 5%, preferably 0.01%–1.0% by weight of a commercial enzyme preparation. Protease enzymes are usually present in such commercial preparations at levels sufficient to provide from 0.0005 to 0.1 Anson units (AU) of activity per gram of composition.

Suitable examples of proteases are the subtilisins which are obtained from particular strains of *Bacillus subtilis* and *Bacillus licheniforms*. Another suitable protease is obtained from a strain of *Bacillus*, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo Industries A/S. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, amylases described in British Patent Specification No. 1,296,839 (Novo Industries A/S), RAPIDASE®, International Bio-Synthetics, Inc. and TERMAMYL® and DURAMYL®, Novo Industries A/S.

Suitable lipase enzymes for detergent usage include those produced by microorganisms of the *Pseudomonas* group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P AMANO®, hereinafter referred to as "Amano-P." Other commercial lipases include AMANO-CES®, lipases from *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases from *Pseudomonas gladioli*. The LIPOLASE® enzyme derived from *Humicola lanuginosa* and commercially available from Novo Industries A/S(see also EPO 341,947) is a preferred lipase for use herein.

Enzyme Stabilizing System—The compositions of the present invention may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One possible stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during fabric washing, can be relatively large; accordingly, enzyme stability to chlorine in-use is sometimes problematic. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Likewise, special enzyme inhibition systems can be incorporated such that different enzymes have maximum compatibility. Other conventional scavengers such as bisulfate, nitrate, chloride, phosphate, condensed phosphate, acetate, benzoate, citrate, formate, lactate, malate, tartrate, salicylate, etc., and mixtures thereof can be used if desired. In general, since the chlorine scavenger function can be performed by ingredients separately listed under better recognized functions, there is no absolute requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is majorly incompatible, as formulated, with other reactive ingredients, if used.

The compositions of the present invention may contain any of the water-soluble formates described in U.S. Pat. No. 4,318,818, Letton et al, issued Mar. 9, 1982, incorporated herein by reference. Formate is present at a level of from about 0.05% to about 5%, preferably from about 0.2% to about 2%, most preferably from about 0.4% to about 1.5%, by weight of the composition.

Other suitable detergent ingredients that can be added are enzyme stabilizers are the enzyme oxidation scavengers which are described in Copending European Patent application 92870018.6 filed on Jan. 31, 1992. Examples of such enzyme oxidation scavengers are ethoxylated tetraethylene polyamines.

Enzymes for use in detergents can be stabilized by various other techniques as well, for example those disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful *Bacillus*, sp. AC13 giving proteases, xylanases and cellulases, is described in WO 9401532 A to Novo. A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al. Enzyme stabilization systems are also described, for example, in U.S. Pat. No. 3,519,570.

Particulate Soil Removal/Anti-redeposition Agents—The compositions of the present invention can also optionally contain water-soluble ethoxylated amines having clay soil removal and anti-redeposition properties. Liquid detergent compositions typically contain about 0.01% to about 5%.

The most preferred soil release and anti-redeposition agent is ethoxylated tetraethylene-Pentamine ("TEPA"). On average, tetraethylene-pentamine is ethoxylated with 15–18 moles of ethylene oxide at each hydrogen site. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti-redeposition agents known in the art can also be utilized in the compositions herein. Another type of preferred anti-redeposition agent includes the carboxy methyl cellulose (CMC) materials. These materials are well known in the art.

Dye Transfer Inhibiting Agents—An important part of the present invention is providing color care for delicate garments and fabrics which are cleaned according to the aqueous cleaning processes described herein. Thus, the compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers suitable for use herein contain units having the following structural formula: $R—A_x—P$; wherein P is a polymerizable unit to which an N—O group can be attached or the N—O group can form part of the polymerizable unit or the N—O group can be attached to both units; A is one of the following structures: —NC(O)—, —C(O)O—, —S—, O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

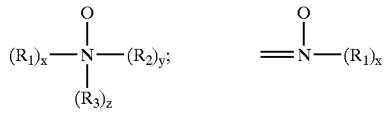

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000.

An example of a polyamine N-oxide useful in the detergent compositions herein is poly(4-vinylpyridine-N-oxide) which as an average molecular weight of about 50,000 and an amine to amine N-oxide ratio of about 1:4. This preferred class of materials can be referred to as "PVNO".

Copolymers of N-vinylpyrrolidone and N-vinylimidazole polymers (referred to as a class as "PVPVI") are also suitable for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from about 5,000 to about 400,000, preferably from about 5,000 to about 200,000, and more preferably from about 5,000 to about 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from about 500 to about 100,000, preferably from about 1,000 to about 10,000. Preferably, the ratio of PEG to PVP on a ppm basis delivered in wash solutions is from about 2:1 to about 50:1, and more preferably from about 3:1 to about 10:1.

Additional Color Care Agents—In addition to the dye transfer inhibitors, the present invention further comprises an additional agent to provide color care benefits: 30 polyethyleneimine, PEI 600 E20, having the general formula:

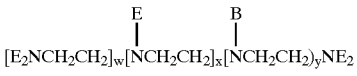

wherein B is a continuation by branching of the polyethyleneimine backbone. E is an ethyleneoxy unit having the formula:

$$—(CH_2CH_2O)mH$$

wherein m has an average value of about 20. What is meant herein by an average value of 20 is that sufficient ethylene oxide or other suitable reagent is reacted with the polyethyleneimine starting material to fully ethoxylate each N—H unit to a degree of 20 ethoxylations. However, those skilled in the art will realize that some N—H unit hydrogen atoms will be replaced by less than 20 ethoxy units and some will be replaced by more than 20 ethoxy units, therefore, the average of the number of ethoxylations is 20.

The units which make up the polyalkyleneimine backbones are primary amine units having the formula:

$$H_2N—CH_2CH_2]\text{- and } —NH_2$$

which terminate the main backbone and any branching chains, secondary amine units having the formula:

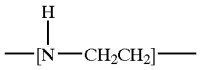

and which, after modification, have their hydrogen atom substituted by an average of 20 ethyleneoxy units, and tertiary amine units having the formula:

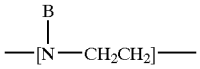

which are the branching points of the main and secondary backbone chains, B representing a continuation of the chain structure by branching. The tertiary units have no replaceable hydrogen atom and are therefore not modified by substitution with ethyleneoxy units. During the formation of the polyamine backbones, cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines.

The indices w, x, and y have values such that the average molecular weight of the polyethyleneimine backbone prior to modification is about 600 daltons. In addition, those skilled in the art will recognize that each branch chain must terminate in a primary amine unit, therefore the value of the index w is y+1 in the case where no cyclic amine backbones are present. The average molecular weight for each ethylene backbone unit, $—NCH_2CH_2—$, is approximately 42 daltons.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Suds Suppressors—Compounds for reducing or suppressing the formation of suds can be incorporated into the compositions of the present invention. Suds suppression can be of particular importance in the so-called "high concentration cleaning process" as described in U.S. Pat. Nos. 4,489,455 and 4,489,574 and in front-loading European-style washing machines.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetra-alkyldiamine chlortriazines, monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of about −40° C. and about 50° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by M. Starch.

Other silicone suds suppressors are disclosed in U.S. Pat. No. 3,455,839 which relates to compositions and processes for defoaming aqueous solutions by incorporating therein small amounts of polydimethylsiloxane fluids. Mixtures of silicone and silanated silica are described, for instance, in German Patent Application DOS 2,124,526.

In the preferred silicone suds suppressor used herein, the solvent for a continuous phase is made up of certain polyethylene glycols or polyethylene-polypropylene glycol copolymers or mixtures thereof, or polypropylene glycol. The primary silicone suds suppressor is branched/crosslinked and preferably not linear.

The silicone suds suppressor herein preferably comprises polyethylene glycol and a copolymer of polyethylene glycol/polypropylene glycol, all having an average molecular weight of less than about 1,000, preferably between about 100 and 800. The polyethylene glycol and polyethylene/polypropylene copolymers herein have a solubility in water at room temperature of more than about 2 percent of the composition by weight, preferably more than about 5 percent of the composition by weight.

The preferred solvent herein is polyethylene glycol having an average molecular weight of less than about 1,000, more preferably between about 100 and 800, most preferably between 200 and 400, and a copolymer of polyethylene glycol/polypropylene glycol, preferably PPG 200/PEG 300. Preferred is a weight ratio of between about 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101®.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12®. Mixtures of secondary alcohols are available under the trademark ISALCHEM 123® from Enichem. Mixed suds suppressors typically comprise mixtures of alcohol+silicone at a weight ratio of 1:5 to 5:1.

For the present detergent compositions which are to be used in laundry washing machines, suds should not form to the extent that they overflow the washing machine. Suds suppressors, when utilized, are preferably present in a "suds suppressing amount". By "suds suppressing amount" is meant that the formulator of the composition can select an amount of this suds controlling agent that will sufficiently control the suds to result in a low-sudsing laundry detergent for use in automatic laundry washing machines.

The compositions herein will generally comprise from 0% to about 5% of suds suppressor. When utilized as suds suppressors, monocarboxylic fatty acids, and salts therein, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Polymeric Soil Release Agent—Soil release agents may be used in the present invention. If so they will generally comprise from about 0.01% to about 10.0%, by weight, of the detergent compositions herein, typically from about 0.1% to about 5%, preferably from about 0.2% to about 3.0%.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and its blends, and hydrophobic segments, to deposit upon hydrophobic fibers and remain adhered thereto through completion of washing and rinsing cycles and thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b). Other suitable polymeric soil release agents are disclosed in U.S. Pat. No. 5,415,807, issued May 16, 1995 to Gosselink, which is hereby incorporated by reference.

Other Components—Other optional ingredients for the compositions herein include but are not limited to hydrotropes, antibacterial agents, additional enzyme stabilizers and perfumes. Especially desirable are anti-shrinkage agents, anti-wrinkle agents, fabric crisping agents and other fabric color protection agents. The pH of the composition as disclosed here will be between 5 and 9.

The Flexible Wrap Container

The action of the agitator in a clothes washer has long been known to expose delicate fabrics to sufficient abrasion and stress that severe damage can occur as a result. As a result, bags have been developed which can be used in a washing machine to protect these garments from abrasion and stress. Nonetheless these have proved unsatisfactory for a variety of reasons. First, they are generally too small to contain anything but one or two small garments-and even then may bunch-up the garments and exacerbate wrinkling and shape loss. Second, many of these bags do not have a reliable closure means, and so the bag often comes open during washing, depriving the garments of the protection the bag is supposed to provide and likely increasing the abrasion and wear on the garments. Third, these bags are often constructed to have an outer shell made of a grid-like netting which allows contact between the wash liquor and the garment to provide cleaning benefits; but this grid-like pattern can also leave an identical grid impression on the garments contained inside. Such a pattern may be virtually impossible to iron out. Fourth, these bags are generally too thin and do not provide enough cushion from the abrasion and stress that a delicate garment may experience in a laundry washing machine.

A preferred flexible wrap container ("wrap") made in accordance with the present invention which remedies many of these problems is shown in FIGS. 1, 1A, 2 and 16. The wrap 122 comprises a single, preferably rectangular, panel 100. The dimensions of the panel 100 are such that the width will be about 31 cm to about 91 cm and the length will be about 55 cm to about 117 cm; more preferred is a width of about 41 cm to about 81 cm and a length of about 66 cm to about 107 cm and most preferred is a width of about 51 cm to about 71 cm and a length of about 76 cm to about 97 cm. In a rectangular embodiment as depicted in FIG. 1, the distance from the top edge of the panel 102 to the bottom edge of the panel 101 is greater than the distance from the right edge of the panel 103 to the left edge of the panel 104.

The wrap further comprises one or more straps 108 which are attached adjacent to the top edge of the panel 102. At an end of each strap is a first fastening device 109 which is fixably and permanently attached to each strap 108 so that its position on the strap does not change. A second fastening device 106 is preferably attached to each strap by passing the strap through the fastening device in such a way that changing its position on the strap, the length of the strap 105 can be increased or decreased. The first and second fastening devices cooperate to secure the flexible wrap container in a roll-like shape during use (see, e.g., FIG. 7). Additionally, two pockets 110 are attached adjacent to the top edge of the panel in the manner shown by FIGS. 1, 1A, 2 and 3. As discussed more fully hereafter, the pockets 110 are used for storing the straps and fastening devices when they are not needed.

The fastening devices used herein are reusable mechanical fasteners. Any reusable mechanical fastener or fastening means can be used. Non-limiting examples include: fasteners wherein said first and second fastening devices, together, comprise a hook and loop (VELCRO@-type) fastener; hook fasteners such as described in U.S. Pat. No. 5,058,247 to Thomas & Blaney issued Oct. 22, 1991; fasteners wherein said first and second fastening devices, together, comprise a hook and string type fastener; fasteners wherein said first and second fastening devices, together, comprise a toggle-type fastener; fasteners wherein said first and second fastening devices, together, form a snap-type fastener; as well as hook and eye fasteners, zipper-type fasteners, releasable buckle type fasteners as used in U.S. Pat. No. 5,330,141, to Kim, issued Jul. 19, 1994, and the like, so long as the fasteners will not cause tearing or abrasion of the garments contained inside the bag. As will be apparent, a single fastening device can also be utilized with one or more straps to secure the wrap container as a roll.

The flexible wrap container may be constructed from a woven polyester layer or woven nylon layer or a combination thereof. The flexible wrap may also be made from a nonwoven polyethylene, polypropylene or polyester. The flexible wrap is preferably constructed to have a density greater than the density of water at standard temperature and pressure so that the flexible wrap container is more likely to sink in the wash water and thus will provide better wetting and rinsing to a garment contained therein. The material should be flexible, yet durable enough to be used for multiple uses. To insure that water can easily penetrate through the wrap material to contact the articles of clothing contained inside, the wrap should be provided with a series of holes or other openings (e.g. FIG. 16) or the wrap material should be permeable to water.

Figure 7:
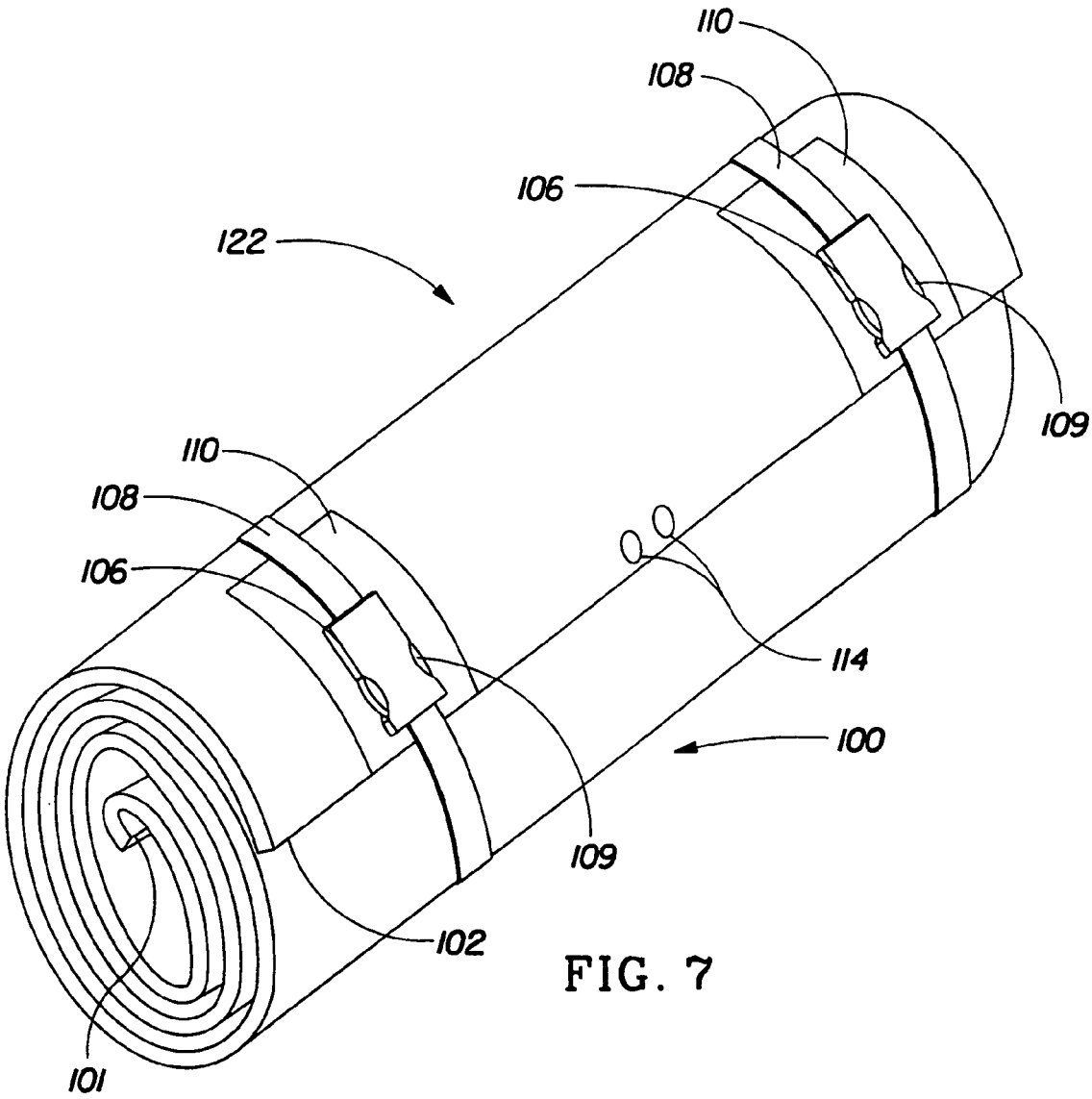
FIG. 7 is a perspective of the flexible wrap container 122 in a roll-like shape.
Figure 8:
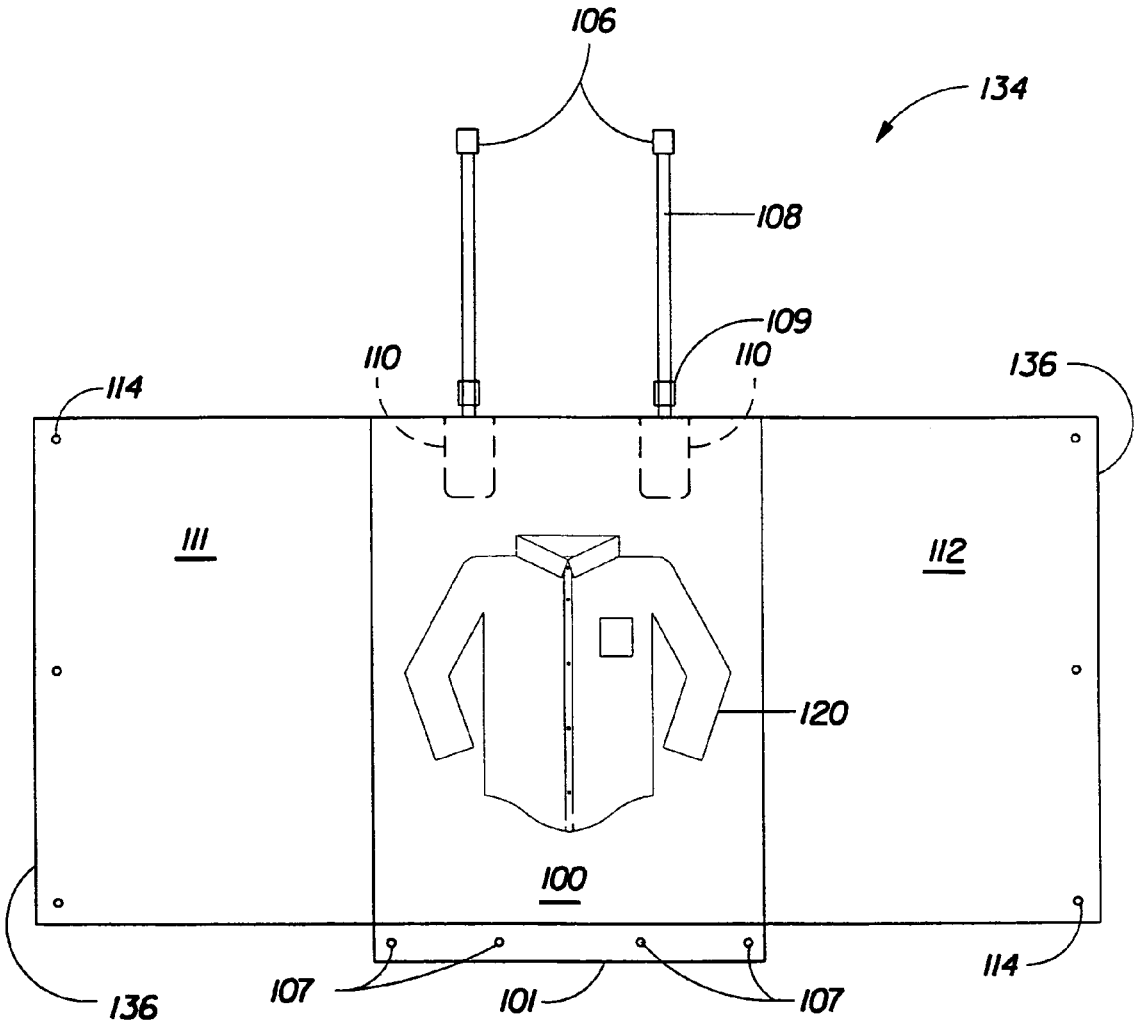
FIG. 8 is a top planar view of a preferred flexible wrap container made in accordance with the present invention, wherein overlapping first and second flaps which are illustrated in an open position.
Figure 12:
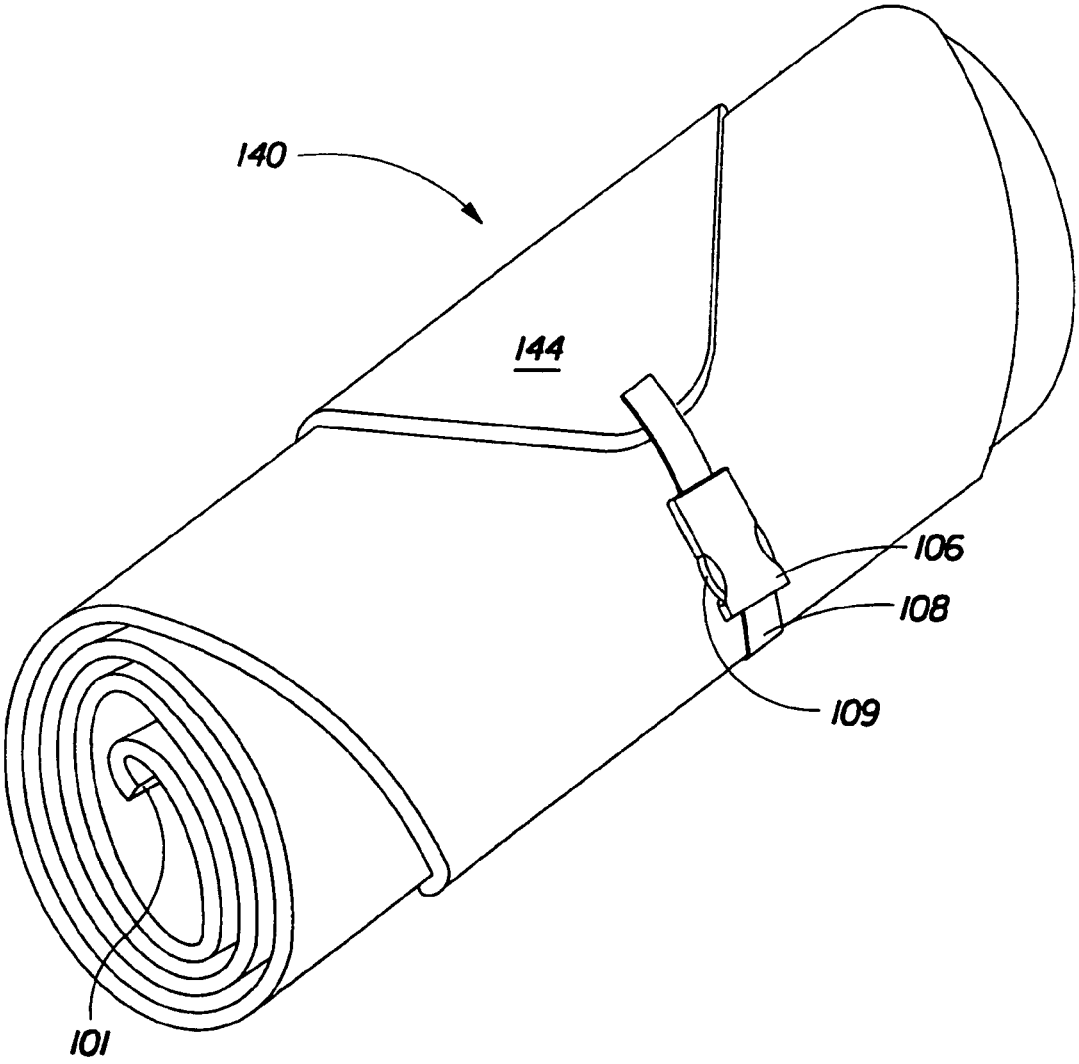
FIG. 12 is a perspective view of the flexible wrap container of FIG. 11, wherein the flexible wrap container is illustrated in a roll-like shape.

Referring now to FIG. 8, the manner in which the wrap is used in the present invention is straightforward. A garment 120 is placed on the panel portion of the wrap 100 with suitable care exercised so that no part of a garment is outside the dimensions of the panel. After placing the garment on the panel, the wrap is then rolled, starting at the bottom edge of the panel 101, as one would roll a sleeping bag for storage purposes after being used. The wrap should not be so tightly rolled that the garment inside might be subject to excessive wrinkling. When rolling is completed the wrap 122 should be in the spiral shape as illustrated by FIG. 7. As seen in FIG. 12, the length of each strap has been adjusted so that when the first and second fastening devices are engaged, the straps are tightly securing the rolled wrap.

Figure 2:
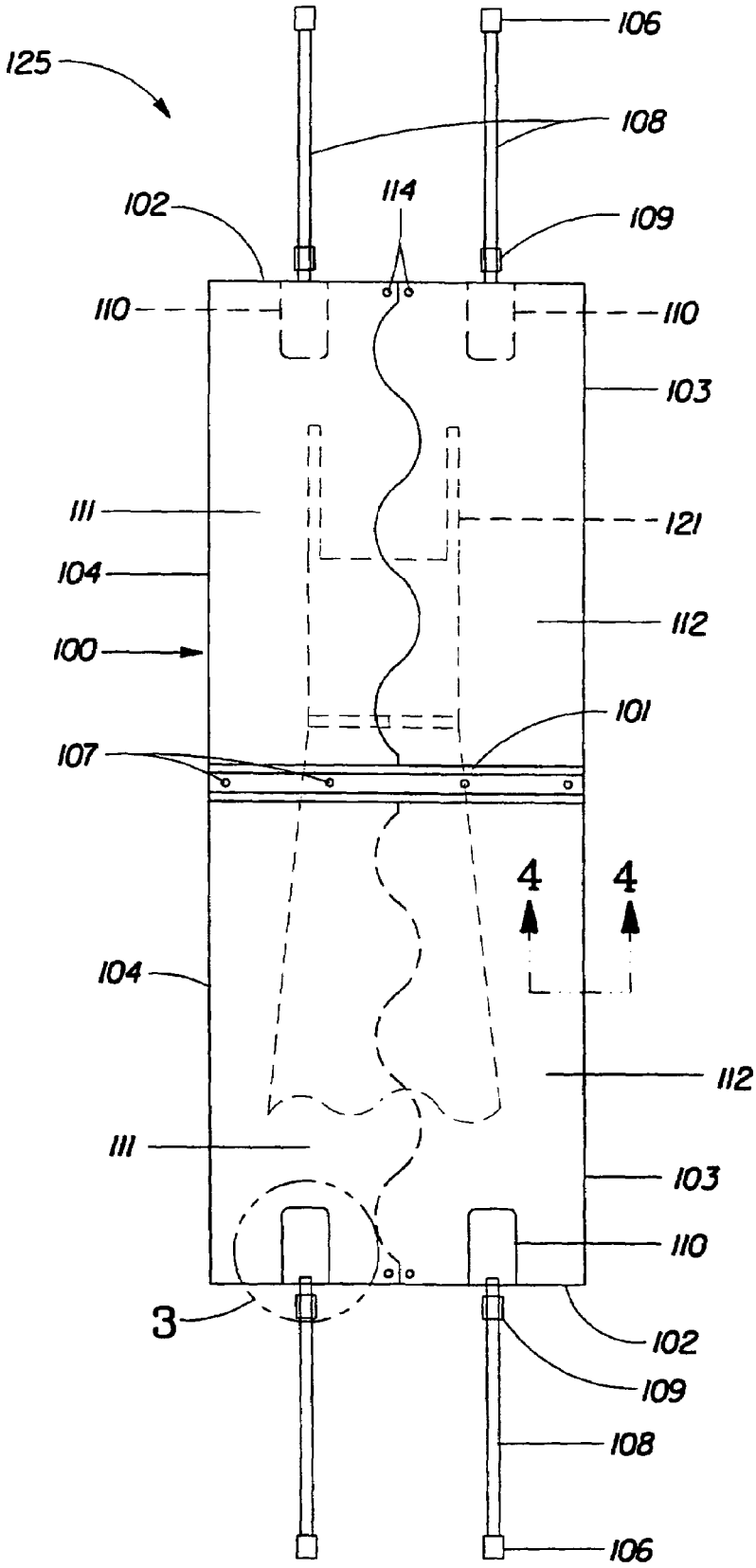
FIG. 2 is a side view illustrating an enlarged flexible wrap container 125. In this embodiment, the two wraps can be attached to each other via connecting means 107 located adjacent to the bottom edge of the panel 101 of each flexible wrap container 122 (of FIG. 1) to form an enlarged flexible wrap container 125.
Figure 3:
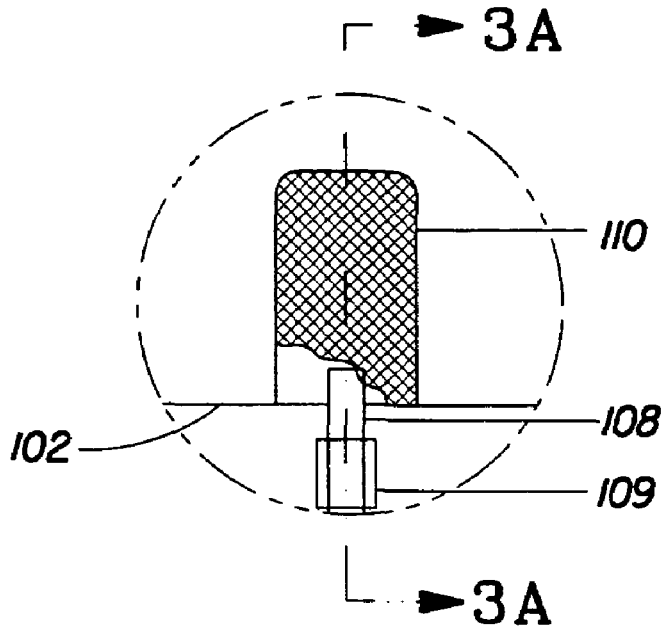
FIG. 3 is a detail illustrating a pocket 110 attached to the panel 100 of the flexible wrap container which provides a storage area for the extra straps and fastening devices when two flexible wrap containers are attached to form an enlarged flexible wrap container as in FIG. 2.
Figure 3A:
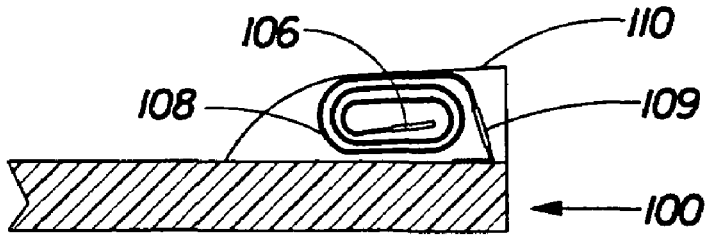
FIG. 3A is a sectional side view of the pocket 110 illustrating the storing of straps and fastening devices in the attached pockets when two flexible wrap containers are attached to form an enlarged flexible wrap container as in FIG. 2

Located adjacent to the bottom edge of the panel are at least two, preferably at least four, connecting means 107 which in a preferred embodiment are snap-type buttons. The wraps are constructed in such a way that an enlarged wrap 125 may be constructed by attaching two wraps to each other via the connecting means 107 located adjacent to the bottom edge of each panel. This construction can be seen in FIG. 2. When the wraps are so connected, the panel of one wrap partially overlaps the panel of the other wrap as can be seen in FIG. 2. An enlarged wrap 125 can accommodate larger garments (such as a dress 121) than a single wrap 122.

When two wraps are attached to each other via the connecting means 107 located adjacent to the bottom edge of each panel as in the alternate embodiment depicted in FIG. 2, there are an extra set of straps 108 and first and second fastening devices 106, 109. The straps and the fastening devices are then placed for storage in the nearest attached pocket 110.

Figure 1A:
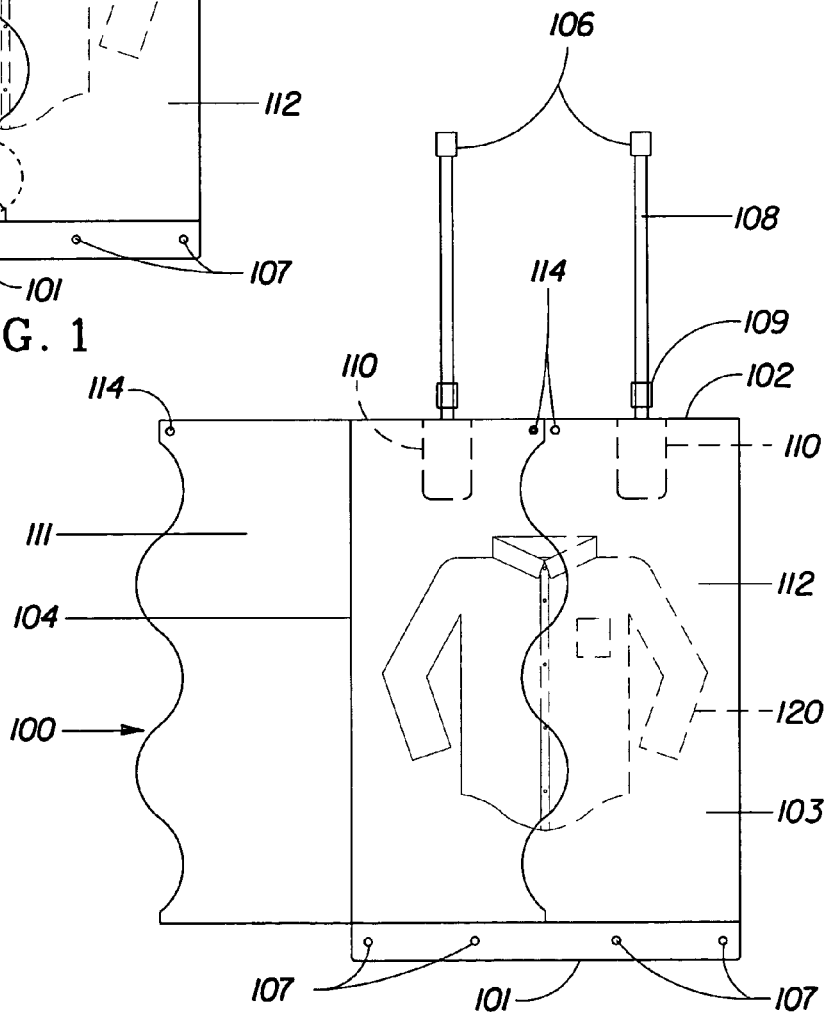
FIG. 1A is a side view illustrating the flexible wrap container 122 and showing two attached flaps, a first flap 111 being folded out and a second flap 112 being folded over the panel.

In a preferred embodiment, the wrap further consists of two flaps 111,112. As shown in FIG. 8, the flaps are attached to the panel along the right edge of the panel 103 and along the left edge of the panel 104. Each flap has a surface area of from about ½ to 1 times the surface area of the panel to which it is attached. So when the flaps are folded inwardly and laid on top of the panel area, they completely cover the panel, essentially adding a second panel layer to the wrap. In the embodiment shown in FIGS. 1, 1A and 2, each flap has a mating sinusoidal design—although not an essential part of the present invention, the mating sinusoidal shape contributes to the overall integrity of the rolled wrap by fitting the two flaps 111, 112 more securely to each other than if the flaps had a conventional rectangular shape. FIG. 1A shows these two flaps: one being folded out 111 and one being folded over the panel 112. The flaps 111,112 and the panel 100 are also equipped with attaching devices 114 which are located adjacent to the top edge of the panel 102. When attached to each other these attaching devices secure the flaps to the panel 100.

Figure 4:
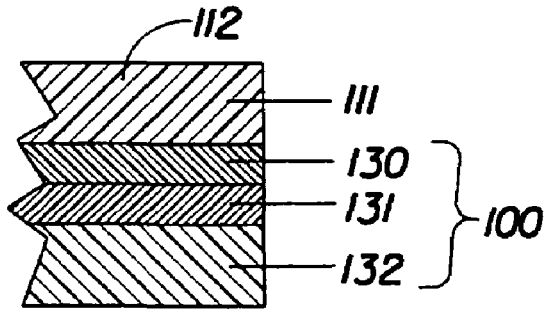
FIG. 4 is an enlarged sectional view showing a profile of the material layers in a preferred embodiment of the flexible wrap container 122.

In one embodiment of the present invention the wrap is constructed from four different layers as is shown in FIG. 4. These four layers provide a significant amount of cushioning to the delicate garments which may be placed inside. The panel 100 is a layered material, comprising a core material 131 between a first layer material 130 and a second layer material 132, the core material being polyester, the first layer material and the second layer material being nylon and the first flap and second flap each constructed from polyester. Optionally, the second layer material of nylon and the polyester material that forms the flaps are woven in such a way that they are provided with numerous small holes or pores 99 (e.g. FIG. 16) through which water may pass either into or out of the interior of the rolled wrap while the second layer material does not have any such holes but is water permeable.

When the preferred flexible wrap container is used, it may contain two garments: one placed directly on top of the panel and the other placed on top of the flaps after they are folded across the garment on the panel.

Figure 9:
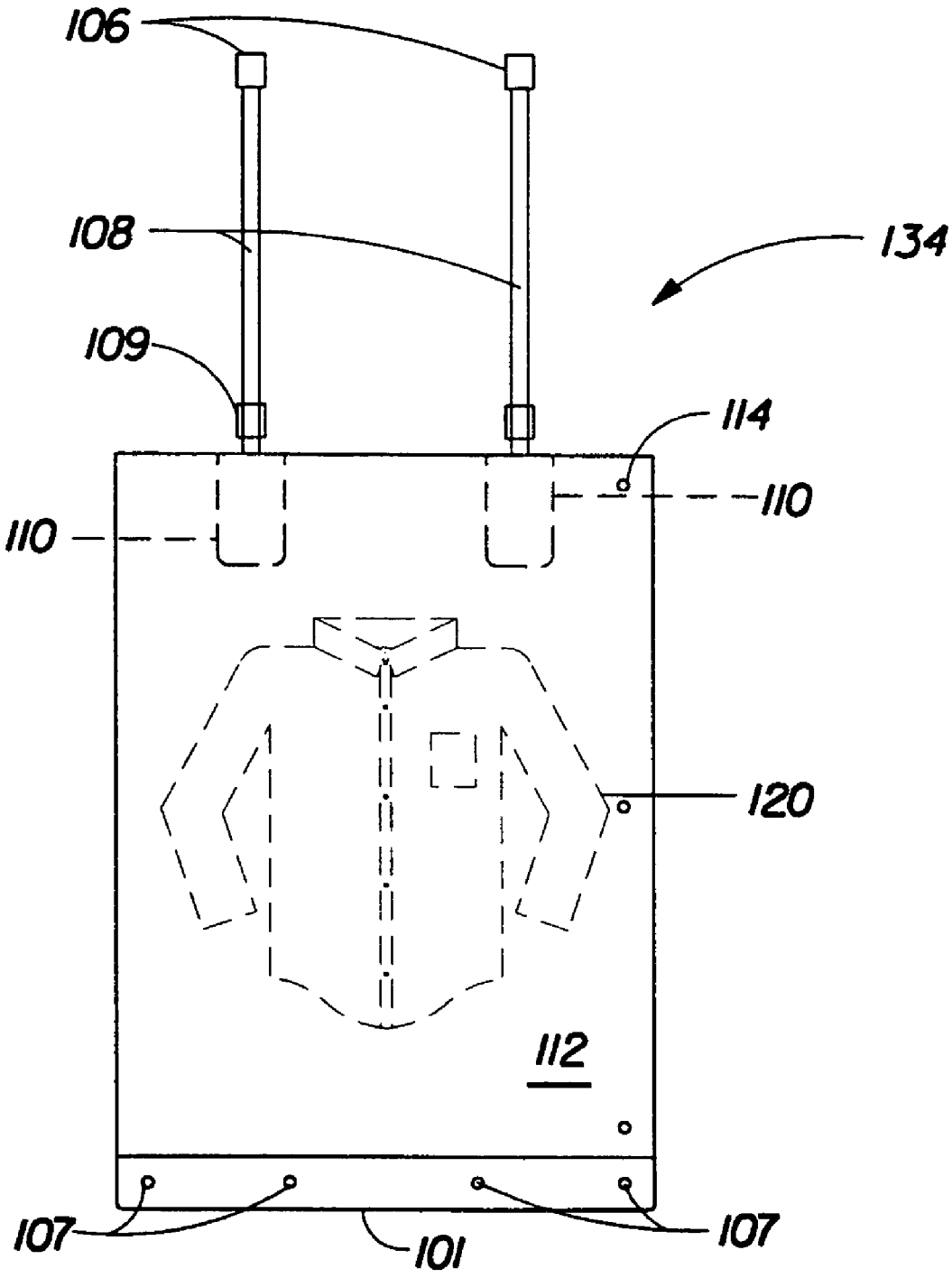
FIG. 9 is a top planar view of the flexible wrap container of FIG. 8, wherein the first and second flaps have been folded over the right and left edges of the panel of the flexible wrap container.

Referring to FIGS. 8 and 9, another preferred flexible wrap container made in accordance with the present invention is illustrated. The flexible wrap container 134 comprises the flexible panel 100 and a first flap 111 and a second flap 112. The first and second flaps 111 and 112 each preferably have a width about equal to the width of the flexible panel 100. More preferably, the first and second flaps 111 and 112 have a width between about 40 cm and about 70 cm for a flexible panel 100 having a width between about 45 cm and about 72 cm. In other words, the first flap 111 preferably extends adjacent to the right edge of the panel 100 when the first flap 111 is folded about the left edge of the panel 100 and the second flap 112 preferably overlaps the first flap 111 when folded about the right edge of the panel 100 and extends adjacent to the left edge of the panel 100. The flexible panel 100 and the first and second flaps 111 and 112 can be provided as separate structures and attached to the flexible panel 100 or the flexible panel 100 and the flaps 111 and 112 can be formed from a unitary material. While the distal or unattached edges 136 of the flaps 111 and 112 are illustrated as straight, other edge configurations, such as the previously described sinusoidal shape, can be provided. Further, three attaching devices 114 (e.g., snaps, hook and loop fasteners, magnetic fasteners, etc.) can be provided along one or more of the distal edges 136 of the flaps 111 and 112 to secure the flaps to each other and/or the flexible panel 100.

Figure 10:
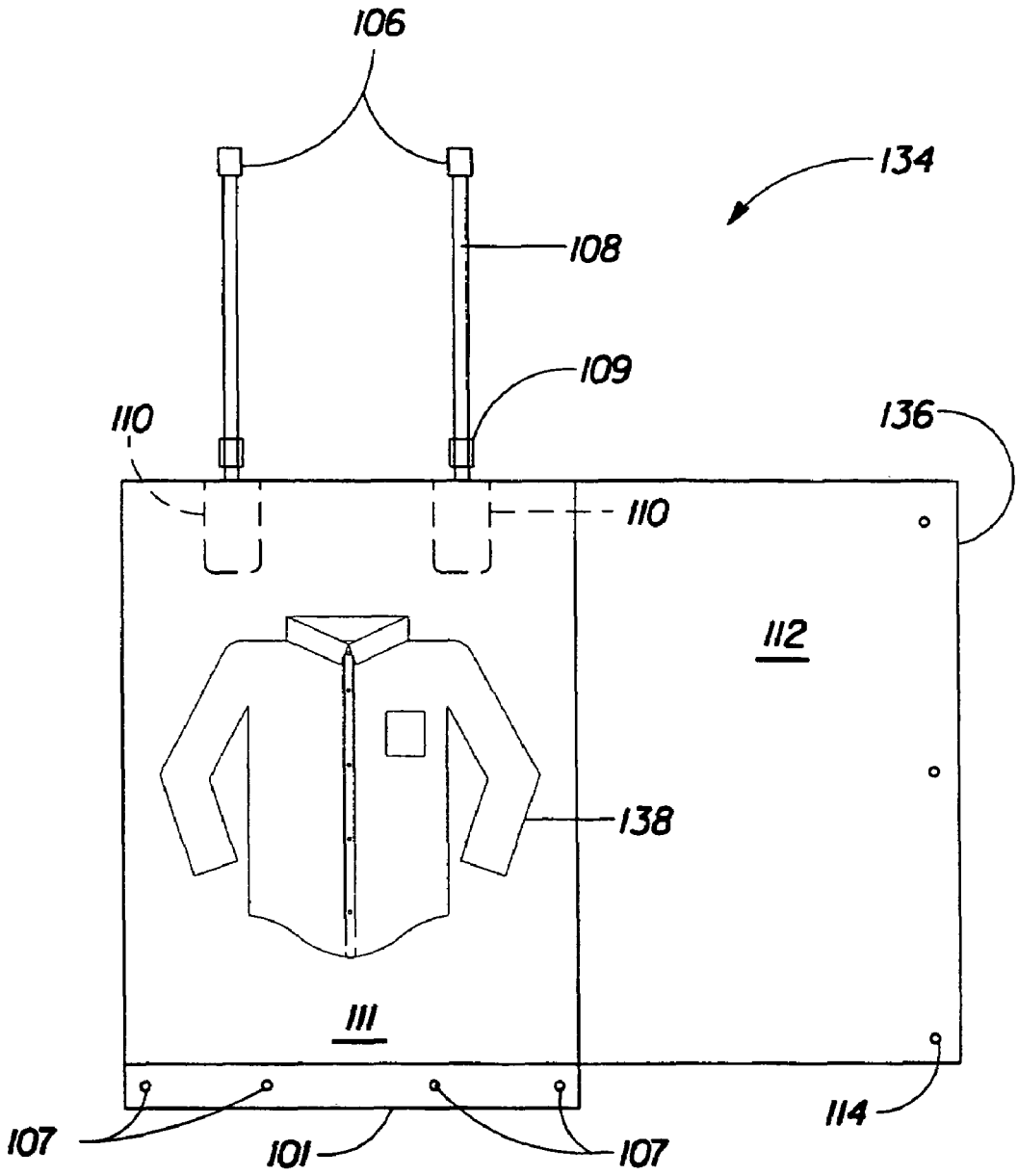
FIG. 10 is a top planar view of the flexible wrap container of FIG. 8, where the first flap has been folded over the left edge of the panel to illustrate placement of a second garment in the flexible wrap container.

Referring still to FIGS. 8 and 9, the overlapping flaps 111 and 112 deliver several benefits. For example, the increased width of the flaps 111 and 112 moves the distal edges 136 of the overlapping flaps 111 and 112 toward the right and left edges of the panel 100 and away from contact with the garment 120. This can reduce the likelihood that seams or stitching of the distal edges 136 will leave an impression upon the garment 120 during use of the flexible wrap container 134. The overlapping flaps 111 and 112 provide an additional layer of protection for the garment 120 and can reduce the risk that portions of the garment 120 will "escape" from the flexible wrap container 134. Overlapping flaps 111 and 112 also provide a flexible wrap container which can accommodate more than one garment. For example, the flaps 111 and 212 are extended to expose the flexible panel 100, as shown in FIG. 8. The garment 120 is placed over the flexible panel 100 and one of the flaps 111 or 112 is folded over the garment 120 as shown in FIG. 10 (flap 111 being illustrated as folded over the garment).

Garment 138 is then placed over the folded flap (e.g., flap 111) and the remaining flap (e.g., flap 112) is folded over the garment 138 and secured using the attaching devices 114, if provided. The flexible wrap container 134 is then rolled and secured using the first and second fastening devices 106 and 109.

While the width of the overlapping flaps 111 and 112 is discussed herein as preferably extending to adjacent the right and left edges of the panel 100, the width of the overlapping flaps 111 and 112 can be between about one half and the full width of the panel 100. Alternatively, although less preferred, a single flap having a width equal to about the width of the panel 100 can be provided in place of the two overlapping flaps 111 and 112. Such an embodiment would preferably include attaching devices 114 to secure the single flap to the flexible panel.

Figure 11:
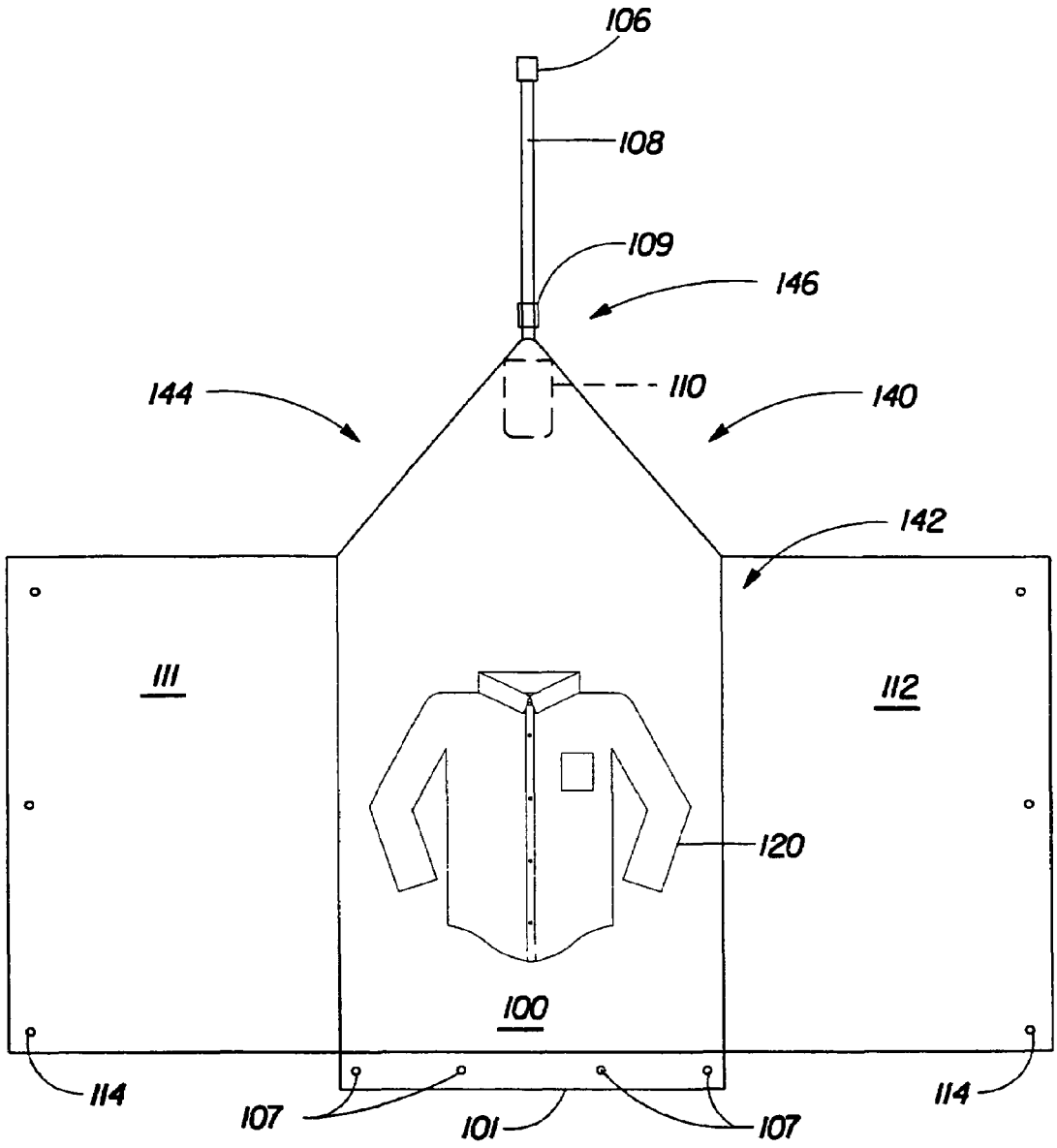
FIG. 11 is a top planar view of another flexible wrap container made in accordance with the present invention, wherein a tapered top portion is provided.

Yet another preferred flexible wrap container is illustrated in FIG. 11. The flexible wrap container 140 comprises a flexible panel 100 having a body 142 with a right edge, left edge, and a bottom edge. The flexible panel 100 also has a tapered top portion 144 which is attached to the body 142. The top portion 144 has an apex 146 which is located at about the mid-point of the body 142. The length of the tapered top portion 144 is preferably at least about one half of the length of the body 142. More preferably, the length of the top portion 144 is between about 40 cm and about 50 cm for a body having a length between about 75 cm and about 80 cm. A single strap 108 is attached adjacent the apex 146 of the top portion 144. At an end of the strap is a first fastening device 109 which is fixably and permanently attached to the strap 108 so that its position on the strap does not change. A second fastening device 106 is attached to the strap as previously discussed.

The inwardly tapering top portion 144 and/or provision of a single strap 106 adjacent its apex 146 can provide several surprising benefits during use of the flexible wrap container 140. The tapered top portion 144, when rolled about the body 142 during use, as shown in FIG. 12, imparts additional structure to the rolled flexible wrap container 140 by virtue of spiral layers 144 which encircle the body 142 when rolled. This additional structure assists in retaining the roll-like shape of the flexible wrap container 140 such that garments stored within the wrap require less finishing as the flexible wrap container 140 has a reduced tendency to twist or unroll from washing machine agitation. The flexible wrap container 140 with its a centrally located strap 108 in combination with the tapered top portion 144 also better resists the formation of gaps between layers of the rolled wrap container through which portions of a garment 120, such as sleeves or a neck, can be extracted during washing machine agitation. While the tapered top portion 140 illustrated herein is preferred, other top portions can be provided in accordance with the present invention. For example, the top portion 144 may displaced from the right and/or left edges of the body 142 or be provided with a larger apex or less of a taper.

Figure 13:
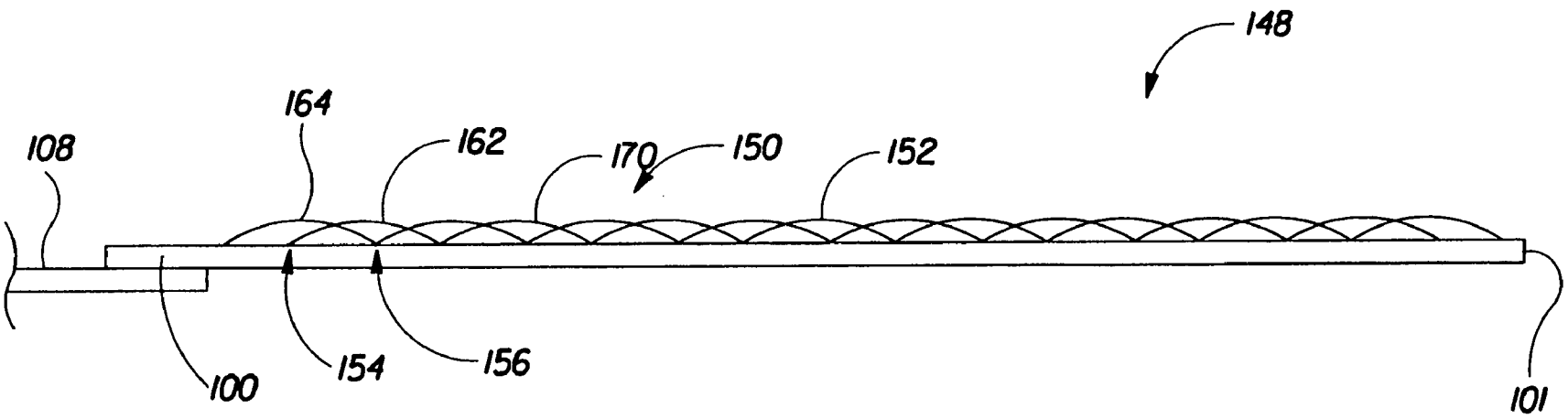
FIG. 13 is a side elevation view of yet another flexible wrap container made in accordance with the present invention, wherein a fence is provided along the edge of the flexible wrap container.
Figure 14:
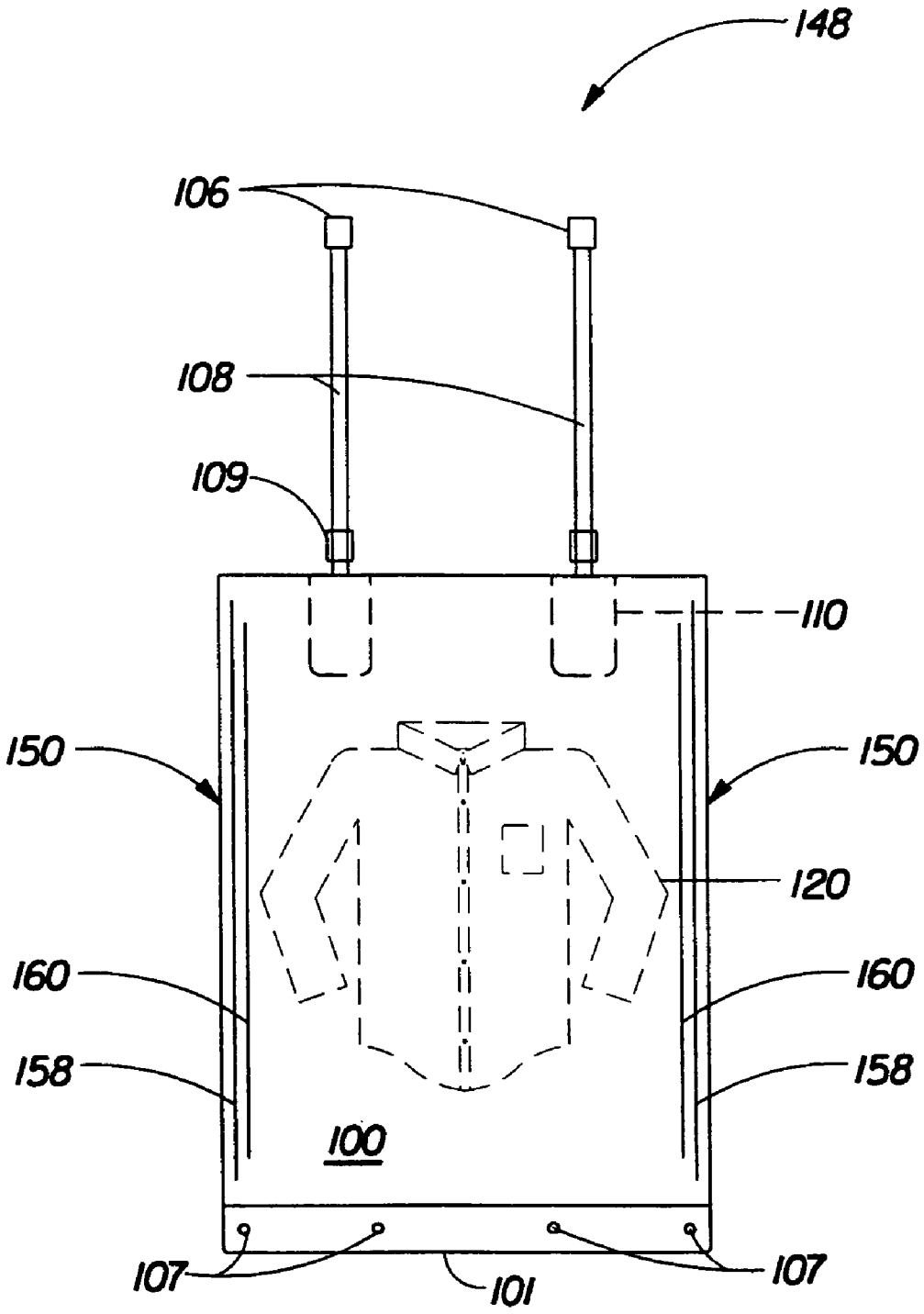
FIG. 14 is a top planar view of the flexible wrap container of FIG. 13.
Figure 15:
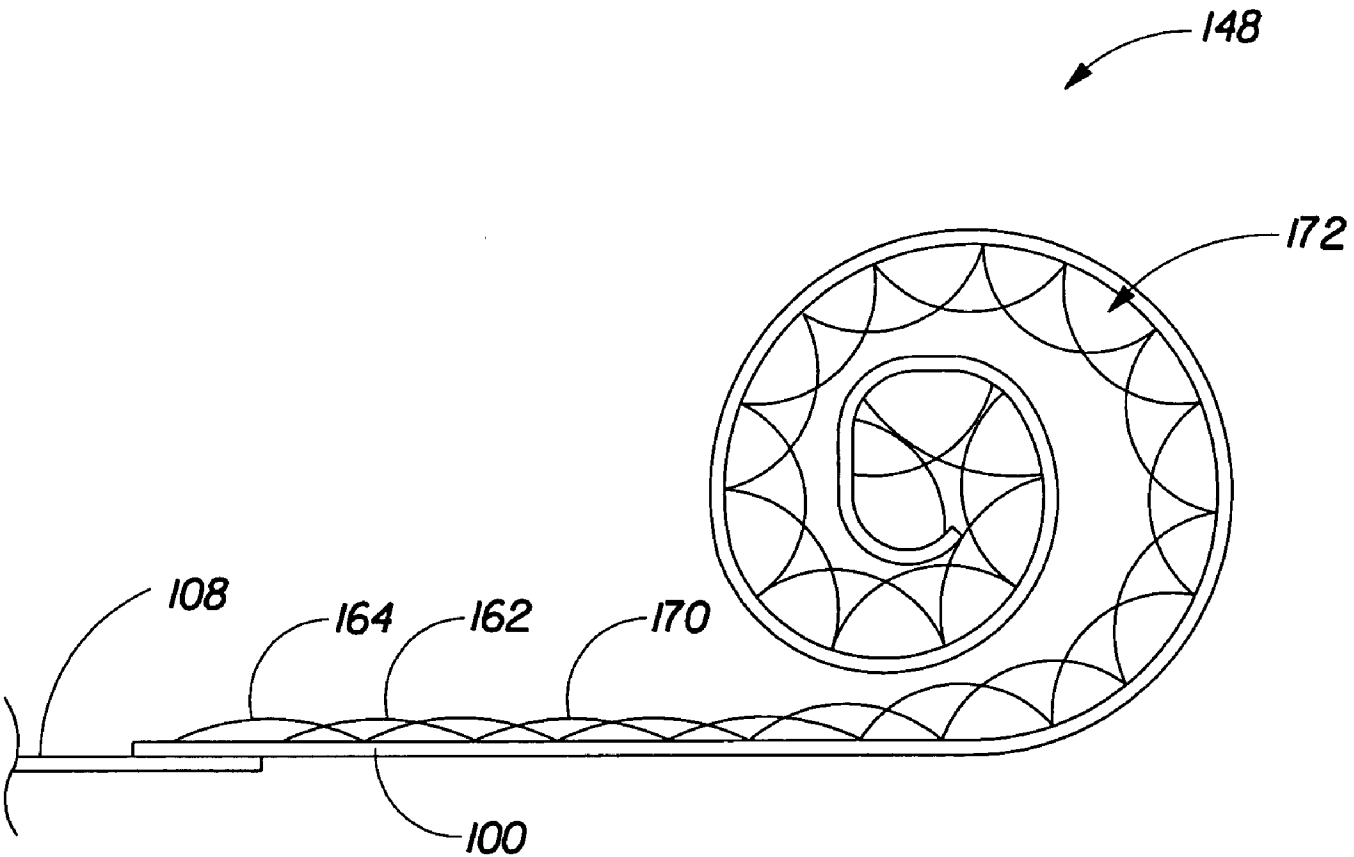
FIG. 15 is a side elevational view of the flexible wrap container of FIG. 13, wherein the flexible wrap container is illustrated in a roll-like shape.
Figure 16:
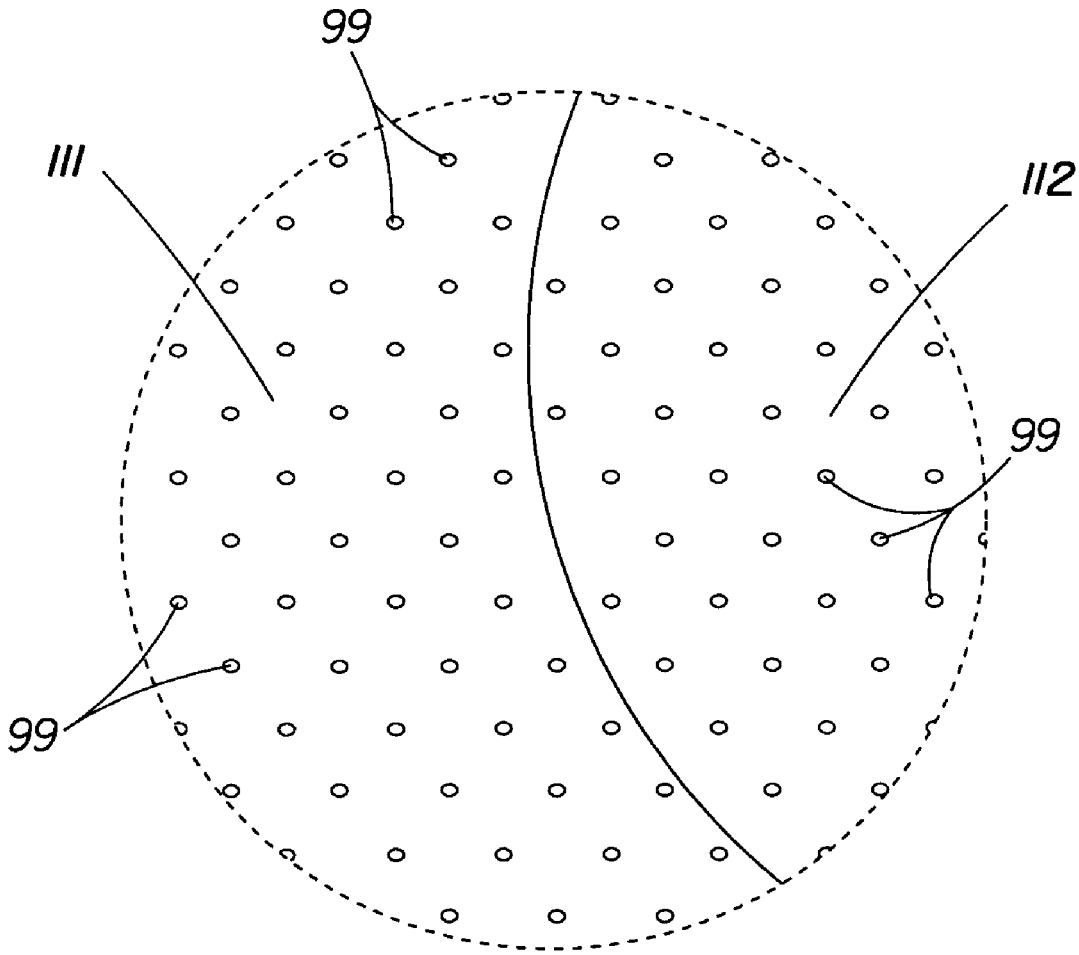
FIG. 16 is an enlarged partial view of the flexible wrap container of FIG. 1.

Referring to FIGS. 13, 14, and 15, still a further preferred flexible wrap container made in accordance with one aspect of the present invention is illustrated. The flexible wrap container 148 has a flexible panel 100 with a right edge, left edge, and bottom edge. Disposed adjacent each of the right and left edges of the panel 100 is a fence 150. The fences 150 can be provided in place of the previously described flaps for retaining a garment within a flexible wrap container. The fences 150 can be formed from a plurality of loops 152 whose ends 154 and 156 are attached to the flexible panel 100. The loops 152 can be formed from polyester filaments, or a similar material, and attached to the flexible panel 100 by stitching, heat sealing, hot glue, cold glue, ultrasonic welding, etc. The loops 152 are preferably formed into a first row 158, wherein the loops 152 of the first row are disposed end to end, and a second row 160, wherein the end of the loops are also disposed substantially end to end. Preferably, the first loop 162 of the second row 160 begins at about the mid-point of the first loop 164 of the first row 158, as shown in FIG. 13, and the opposite end of the first loop 162 of the second row 160 terminates at about the mid-point of second loop 170 of the first row 158, although the beginning location of the second row can be varied. The loops preferably lay substantially flat when the flexible wrap container is unrolled and are flexible enough to rise away from the flexible panel 100 such that loops from the first and second rows 158 and 160 will overlap to form the open fence 150 having openings 172, as best seen in FIG. 13, through which wash water can flow but which are small enough such that the garment is unable to exit the flexible container wrap 148 during use. The filaments forming the loops preferably have a gauge between about 0.25 mm and about 3.175 mm and the opening 172 have an open area between about 1.5 $cm^2$ and about 4.8 $cm^2$.

While the first and second rows 158 and 160 are described herein as distinct rows, it will be understood that a single row can be provided in place of two rows or that more that two rows can be used. Further, it will be appreciated that the gauge and spacing of the loops can be changed to achieve differing degrees of flexibility in the longitudinal direction and garment containment in the transverse direction. Further the longitudinal length of the fences 150 can be varied, although it is preferred that the length extend from adjacent to the top edge of the panel 100 to adjacent to the bottom edge of the panel 100.

The Wash Pretreatment Applicator

Figure 5:
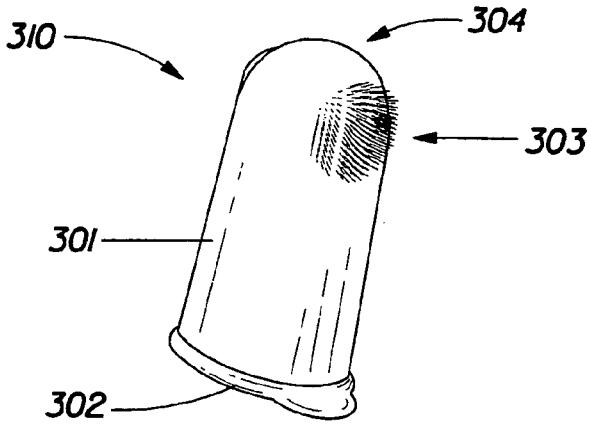
FIG. 5 is a perspective of the wash pretreatment applicator 310 which is used in the present invention to pre-treat stains using hand pressure.
Figure 6:
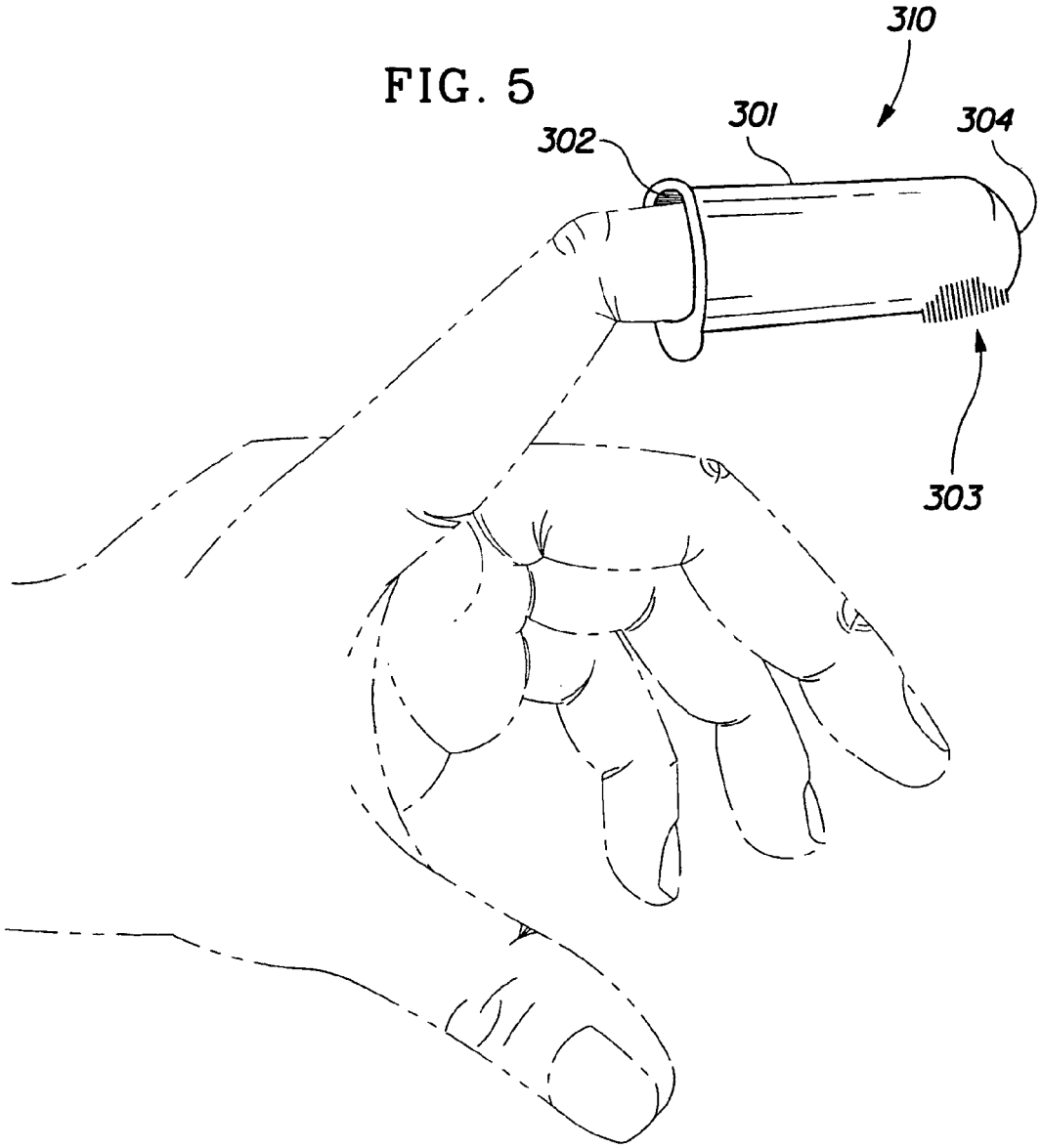
FIG. 6 is a perspective of the wash pretreatment applicator 310 as positioned on a human finger.

As shown in FIGS. 5 and 6, one style of the preferred wash pretreatment applicator employed in the stain-removal process of the present invention is a finger mounted brush suitable for spreading an amount of the pretreatment composition across the stained area of fabric which, along with a very gentle amount of force, allows the pretreatment composition to penetrate into the stain and provide efficacious cleaning benefits. This is, however, only a preferred embodiment as the applicator in the present invention may be as simple as a human finger or any other non-abrasive tool which can apply an effective amount of a wash pretreatment composition to a stained area of a garment while simultaneously effectively providing mechanical action to assist in the stain removal.

FIG. 5 is a perspective illustration showing the applicator 310. The applicator consists of a substantially cylindrical tube 301 having an open end 302 and a closed end 304. The tube 301 is sized and configured to fit snugly around a human finger with the closed end of the tube positioned adjacent to the tip of the finger and the open end of the tube positioned adjacent the second joint of the finger. Brush means 303 are disposed adjacent the closed end portion 304 of the tube 301. The brush means is enclosed within a oval or circle-shaped area and extends generally from the tip of the tube and partially down the side of the tube.

The brush means 303 is conveniently configured to apply an effective amount of a wash pre-treatment composition to a stain covering a localized area of fabric when applied thereto with a brushing motion. The brush means comprises a multiplicity of small bristles provided as a bed or mat that extend outwardly from the closed end portion of the tube 301. The brush means may comprise from about 30 to about 250 bristles per $cm^2$. These bristles may be from about 0.05 to about 1.0 cm long. The bristles are formed as an integral part of the tube 301 during the manufacture thereof such that the bristles and the tube are all fabricated from the same unitary piece of material. The applicator may be made out of any flexible plastic or polymeric material and may be constructed so as to be either durable or disposable.

For aesthetic purposes, ease of manufacture or any other reason the bristles may be arranged in any pattern or grid provided that said pattern efficiently and efficaciously applies the liquid cleaning composition to the localized area of fabric. The choice of the source, style and number of bristles are matters for the manufacture's discretion, and the foregoing illustrations are not intended to be limiting of the invention.

The wash pretreatment applicator herein should be of a size that it comfortably fits on a human finger in the manner illustrated in FIG. 6. In this embodiment, the length of the tube 301 with its generally cylindrical configuration is about 4.5 cm. The diameter of the cylinder at its open end is 2 cm.

Rinse Cycle Conditioner and Rinse Cycle Conditioner Dispenser

The present invention may also include a rinse cycle conditioner which is preferably a fabric softener. The fabric softener provides a number of important benefits. In particular it may provide for improved color fidelity, improved abrasion resistance and limit excessive wrinkling. In particular, fabric softeners help maintain fabric softness of garments like silk, which can have a rough feel after being washed in an aqueous laundry detergent.

The rinse cycle conditioner in the present invention, then it will be composed of the following materials. The following are intended only to be nonlimiting illustrations of such active adjuncts, more examples of which will readily come to mind of the skilled formulator.

Diester Quaternary Ammonium Compound The rinse cycle conditioner may contain the softening active DEQA compounds and compositions containing DEQA as an essential component: DEQA-having the formula:

$$R_{4-m}N^{+}[(CH_2)_nYR^2]_mX^{-}$$

wherein each Y=(O)C—, or —C(O)—O—; m=2 or 3; each n=1 to 4; each R substituent is a short chain $C_1$ –$C_6$, preferably $C_1$–$C_3$, alkyl group, e.g., methyl (most preferred), ethyl, propyl, and the like, benzyl or mixtures thereof; each $R^2$ is a long chain, at least partially unsaturated (IV of greater than about 5 to less than about 100), $C_{11}$–$C_{21}$, hydrocarbyl, or substituted hydrocarbyl substituent and the counterion, $X^-$, can be any softener-compatible anion, for example, chloride, bromide, methylsulfate, formate, sulfate, nitrate and the like. DEQA compounds prepared with fully saturated acyl groups are rapidly biodegradable and excellent softeners. However, it has now been discovered that compounds prepared with at least partially unsaturated acyl groups have many advantages (i.e., concentratability and good storage viscosity) and are highly acceptable for consumer products when certain conditions are met.

Also suitable for use in the present invention as a softening active are amines of the formula:

$$[(R)_{3-m}—N—[(CH_2)_n—Q—R^1]_m]$$

wherein $R^1$ is independently $C_1$–$C_6$ alkyl, $C_1$–$C_6$ hydroxyalkyl, benzyl, and mixtures thereof; $R^1$ is preferably $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from the units having the formula:

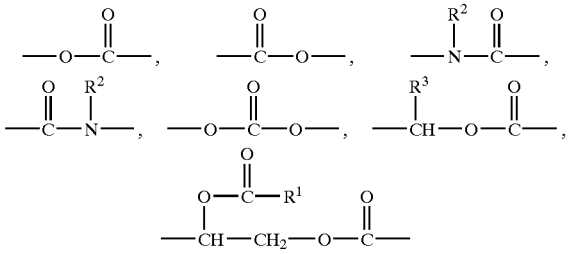

wherein $R^2$ is hydrogen, $C_1$–$C_4$ alkyl, preferably hydrogen; $R^3$ is $C_1$–$C_4$ alkyl, preferably hydrogen or methyl. Further discussion of suitable softening agent species as well as suitable optional ingredients can be found in the copending provisional application of DuVal et al., entitled "Concentrated, Stable, Translucent Or Clear, Fabric Softening Compositions," having P&G Case No. 7039, Ser. No. 60/076,564, having been filed on Mar. 2, 1998, which is hereby incorporated by reference.

Principal Solvents and Hydrotropes—The physical stability and softening performance of the rinse cycle conditioner can be improved by incorporation of certain hydrotropes and principal solvents. The level of principal solvent present in the compositions of the present invention is typically less than about 15%, preferably less than about 12%, most preferably less than about 10% by weight. Some embodiments of the present invention may comprise no principal solvent.

The principal solvents of the present invention are primarily used to obtain liquid compositions having sufficient clarity and viscosity. Principal solvents must also be selected to minimize solvent odor impact in the composition. For example, isopropyl alcohol is not an effective principal solvent in that it does not serve to produce a composition having suitable viscosity. Isopropanol also fails as a suitable principal solvent because it has a relatively strong odor.

Principal solvents are also selected for their ability to provide stable compositions at low temperatures, preferably compositions comprising suitable principal solvents are clear or translucent down to about 4° C. and have the ability to fully recover their clarity if stored as low as about 7° C.

The principal solvents according to the present invention are selected based upon their octanol/water partition coefficient (P). The octanol/water partition coefficient is a measure of the ratio of the concentrations of a particular principal solvent in octanol and water at equilibrium. The partition coefficients are conveniently expressed and reported as their logarithm to the base 10; logP.

The logP of many principal solvent species has been reported; for example, the Ponmona92 database, available from Daylight Chemical Information Systems, Inc.(Daylight CIS), contains many, along with citations to the original literature. Further details and calculating and obtaining logP data can be found in the application of DuVal et al., entitled "Concentrated, Stable, Translucent Or Clear, Fabric Softening Compositions," having P&G Case No. 7039, incorporated above.

The principal solvents suitable for use in the present invention are selected from those having a ClogP of from about 0.15 to about 1, preferably from about 0.15 to about 0.64, more preferably from about 0.25 to about 0.62, most preferably from about 0.4 to about 0.6. Preferably the principal solvent is at least to some degree an asymmetric molecule, preferably having a melting, or solidification point which allows the principal solvent to be liquid at or near room temperature. Low molecular weight principal solvents may be desirable for some embodiments. More preferred molecules are highly asymmetrical.

However, highly symmetrical molecules inter alia 1,7-heptandiol, 1.4-bis(hydroxymethyl)cyclohexane, and cyclohexane, have a center of symmetry which precludes their use as suitable principal solvents even thought they have ClogP values which fall within the desired range.

Preferred principal solvents include mono-alcohols, $C_6$ diols, $C_7$ diols, the isomers of octanediol, derivatives of butanediol, the isomers of trimethylpentanediol, the isomers of ethylmethylpentanediol, the isomers of propylpentanediol, the isomers of dimethylhexanediol, the isomers of ethylhexanediol, the isomers of methylheptanediol, the isomers of octanediol, the isomers of nonanediol, alkyl glyceryl ethers, di(hydroxy alkyl) ethers, aryl glyceryl ethers, the derivatives of alicyclic diols, derivatives of alkoxylated $C_3$–$C_7$ diols, aryl diols, and mixtures thereof as disclosed in WO97/03169 "Concentrated, Stable, Preferably Clear, Fabric Softening Composition" incorporated herein by reference.

Nonlimiting examples of preferred principal solvents include 1,2-hexanediol, 2-ethyl-1,3-hexanediol, alcohol ethoxylates of 2-ethyl-1,3-hexanediol, 2,2,4-trimethyl-1,3-pentanediol, alcohol ethoxylates of 2,2,4-trimethyl-1,3-pentanediol, phenoxyethanol, 1,2-cyclohexanedimethanol, and mixtures thereof.

A preferred embodiment of the present invention is the combination of certain principal solvents. Non-limiting examples of preferred combinations include 2,2,4-trimethyl-1,3-pentanediol (TMPD) in combination with 1,2-hexanediol, 2-ethyl-1,3-hexanediol, or mixtures thereof. These solvent combinations provide increased phase stability across storage temperatures and fully recoverable compositions from below the water freezing point.

For the preceding ester fabric softening agents, the pH of the compositions herein is an important parameter of the present invention. Indeed, it influences the stability of the quaternary ammonium or amine precursors compounds, especially in prolonged storage conditions.

The pH, as defined in the present context, is measured in the neat compositions at 20° C. While these compositions are operable at pH of less than about 6.0, for optimum hydrolytic stability of these compositions, the neat pH, measured in the above-mentioned conditions, must preferably be in the range of from about 2.0 to about 5, preferably in the range of 2.5 to 4.5, preferably about 2.5 to about 3.5. The pH of these compositions herein can be regulated by the addition of a Bronsted acid. Suitable acids are disclosed in the application of DuVal et al., entitled "Concentrated, Stable, Translucent Or Clear, Fabric Softening Compositions," having P&G Case No. 7039, incorporated above.

Soil Release Agent—In the present invention, an optional soil release agent can be added. The softening composition prepared by the process of the present invention herein can contain from 0% to about 10%, preferably from 0.2% to about 5%, of a soil release agent. Preferably, such a soil release agent is a polymer. Polymeric soil release agents useful in the present invention include copolymeric blocks of terephthalate and polyethylene oxide or polypropylene oxide, and the like. A more complete disclosure of soil release agents is contained in U.S. Pat. No. 4,661,267, Decker et al., issued Apr. 28, 1987; U.S. Pat. No. 4,711,730, Gosselink et al., issued Dec. 8, 1987; U.S. Pat. No. 4,749,596, Evans et al., issued Jun. 7, 1988; U.S. Pat. No. 4,818,569, Trinh et al., issued Apr. 4, 1989; U.S. Pat. No. 4,877,896, Maldonado et al., issued Oct. 31, 1989; U.S. Pat. No. 4,956,447, Gosselink et al., issued Sep. 11, 1990; and 4,976,879, Maldonado et al., issued Dec. 11, 1990, all of said patents incorporated herein by reference.

Water—Water is employed in the instant compositions as a liquid carrier due to its low cost relative availability, safety, and environmental compatibility. The level of water in the present compositions is at least about 40%, preferably at least about 50%, by weight of the composition.

Stabilizers—Antioxidants can be present in the compositions of this invention as a stabilizer. Antioxidants are present at a level of from 0% to about 10%, preferably from about 0.01% to about 8%, more preferably from about 0.035% to about 7%. The most prefered antioxidant is DTPA®, available from Aldrich with a chemical name of diethylenetriaminepentaacetic acid.

Chlorine Scavengers—These scavengers are actives that react with chlorine, or with chlorine-generating materials, such as hypochlorite, to eliminate or reduce the bleaching activity of the chlorine materials. Typically, the softener composition of the present invention provides enough chlorine scavenger to react with about 0.2 ppm to about 20 ppm, preferably from about 0.3 ppm to about 10 ppm, and more preferably from about 0.5 ppm to about 8 ppm of chlorine present in an average rinse liquor. Suitable levels of chlorine scavengers in the liquid softener composition of the present invention range from about 0.01% to about 10%, preferably from about 0.02% to about 5%, most preferably from about 0.03% to about 4%. If both the cation and the anion of the scavenger react with chlorine, which is desirable, the level is adjusted to react with an equivalent amount of available chlorine. Preferred examples of chlorine scavengers include ammonium salts, e.g., chloride, bromide, citrate and sulfate. Ammonium chloride is especially preferred.

Bacteriocides—Examples of bacteriocides used in the compositions of this invention include glutaraldehyde, formaldehyde, 2-bromo-2-nitro-propane-1,3-diol sold by Inolex Chemicals, located in Philadelphia, Pa., under trade name Bronopol™, and a mixture of 5-chloro-2-methyl-4-isothiazoline-3-one and 2-methyl-4-isothiazoline-3-one sold by Rohm and Haas Company under the trade name Kathon™ CG/ICP. Typical levels of bacteriocides used in the present compositions are from about 1 to about 1,000 ppm by weight of the composition.

Other Preferred Ingredients—The rinse cycle conditioner of the present invention also preferably includes other components conventionally used in textile treatment compositions such as pH modifiers, chelants, antifoam agents and perfumes. Particularly important for the present invention are additives such as anti-shrinkage agents, anti-wrinkle agents, fabric crisping agents and other fabric color protection agents. Many of the ingredients described above in the section on the liquid cleaning composition may also be selected by a skilled formulator for use in the rinse cycle conditioner.

Other Optional Ingredients—The present invention may also include other optional components conventionally used in textile treatment compositions, for example, colorants, preservatives, opacifiers, fabric conditioning agents, surfactants, stabilizers such as polyethylene glycol, spotting agents, germicides, fungicides, anti-corrosion agents, anti-foam agents, and the like. The present invention does not contain stabilizers such as guar gum.

Suitable liquid fabric softener compositions are further disclosed in U.S. Pat. No. 5,460,736, Trinh et al., issued Oct. 24, 1995; U.S. Pat. No. 5,545,350, Baker et al., issued Aug. 13, 1996; U.S. Pat. No. 5,562,849, Wahl et al., issued Oct. 8, 1996; all of which are hereby incorporated by reference. Commercial products such as DOWNY CARE™ and ULTRA DOWNY™ brand fabric softener may also be used.

The apparatus intended for use in this invention is the one disclosed in U.S. Pat. No. 5,736,503, Dec. 7, 1993, to Baginski et al. which is hereby incorporated by reference. This apparatus is a dosing dispenser, which is designed to be added before the wash cycle of a washing machine (at the beginning of the laundry process) but does not actually release the rinse cycle conditioner until the rinse cycle. As designed the apparatus contains a number of improvements over previous dispensers, in particular it is designed to insure that the amount of additive poured into the apparatus will be the correct dosage for the particular wash process. It also contains an improved sealing structure as well as utilizing a specially-designed recessed valve to minimize the chances that the apparatus will open and spill its contents during the wash cycle. The valve in the apparatus is so configured that it is opened only by the centrifugal force it experiences during the spin cycle so that the additive inside can then be utilized during the subsequent rinse cycle.

In a preferred embodiment, the apparatus used in this invention may be inserted into a fabric glove. This glove prevents the apparatus it contains from abrading or blemishing the delicate garments that it may directly contact-particularly during the agitation cycle of a washing machine.

The glove is constructed so that it fits snugly around the apparatus and will not come off merely as the result of using it as directed herein under standard operating conditions. The glove may be made of any natural or synthetic fabric or blend. Nylon is a preferred fabric.

Absorbent Stain Receiver

The absorbent stain receiver which is used in the present invention includes an absorbent material which imbibes the liquid composition. In preferred modes of operation, the stain receiver is designed specifically to "wick" or "draw" the liquid compositions away from the stained area. The absorbent stain receiver is necessarily white or non-printed to avoid dye transfer from receiver to garment. White or non-printed disposable paper towels, paper towels such as BOUNTY™ brand towels, clean rags, etc., can be used. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils thick. It optionally, but preferably, has a barrier film on its rear surface to prevent the cleaning liquid from passing onto the surface on which the pre-spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer.

Alternatively, the absorbent stain receiver used herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. (FAM foams can be treated to render them hydrophilic. Both the hydrophobic or hydrophilic FAM can be used herein.)

The manufacture of FAM-type foams for use as the stain receiver herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; and U.S. Pat. No. 5,550,167 to DesMarais, issued Aug. 27, 1996.

Process Embodiments

The use of the devices, compositions and processes of this invention are described in more detail hereinafter. Such disclosure is by way of illustration and not limitation of the invention herein.

Although not necessary or essential to the present invention, it is preferable to use a pretreatment procedure to improve the effectiveness of removing stains from a stained area of the garment. This pretreatment procedure comprises applying a pretreatment composition to the stained area and contacting the stained area with the wash pretreatment applicator by applying a gentle brushing motion to distribute the pretreatment composition around the stained area of the garment. The pretreatment composition may or may not then be rinsed off the stained area with water. The liquid cleaning composition may function also as a pretreatment composition or a separately provided pretreatment composition may be used.

In more detail, the pretreatment process herein can be conducted in the following manner. Modifications of the process can be practiced without departing from the spirit and scope of the present invention.

1. Place the stained area of the garment over and in contact with an absorbent stain receiver such as a FAM absorbency pad or a paper towel (preferably a nonwoven pad that is white or non-printed-to avoid dye transfer from towel to garment) or any other stain receiver as described herein on any suitable surface such as a table top etc. The wash pretreatment product is then poured directly onto the stained area.

2. Use the wash pretreatment applicator to spread, in a gentle brushing motion, the pretreatment composition onto the stained area to saturate the localized stained area without saturating the area surrounding it and then subsequently attempting to work out the stain as completely as possible.
3. Optionally, let the composition penetrate the stain for about 1 to 3 minutes.
4. Optionally, apply more of the pretreatment composition onto the stained area.
5. Optionally, rinse the stained area that has been pre-treated with cold tap water.
6. Follow this pretreatment process, perhaps repeating multiple times, with the overall cleaning process described below.

An overall process for treating an entire fabric surface area of a garment, which includes the pretreatment process described above, thus comprises the following steps of:

(i) Optionally, conducting a pretreatment process, according to steps 1–6 of the above disclosure, on a stained area of a garment.

(ii) Placing the pretreated garment from step (i) inside the washing implement in the manner disclosed herein and securing the washing implement so that it will not come open during laundering in the washing machine.

(iii) Placing the washing implement inside a washing machine together with: (1) an apparatus for dispensing a rinse water additive containing a rinse water additive such as fabric softener composition and (2) a measured amount of the liquid cleaning composition.

(iv) Operating the washing machine on its most gentle agitation cycle and using cold water both in the wash and rinse cycles for a period of at least about 6 minutes, typically from about 4 minutes to about 12 minutes.

(v) Removing the flexible wrap container containing the clean garments from the washing machine, removing the garment or garments from the flexible wrap container and either allowing them to air dry or first placing them in a clothes dryer set on air-fluff (no heat) for silk garments or the lowest possible dryer heat setting for garments made from rayon and rayon blends. Heavy weight garments should remain in the dryer for 8 to 10 minutes, while light weight garments should remain for 4 to 6 minutes. The garments should then be removed and allowed to air dry. Wool garment should not be placed in a clothes dryer.

With respect to step (ii), it is appreciated that for fabrics which tend to wrinkle, it is preferred not to overload the washing implement used herein.

In step (iii), the washing machine may have an agitator arranged on either a substantially horizontal or substantially vertical axis. Typically, such an amount of liquid cleaning composition will be added so that the concentration of active ingredients in the wash liquor is from about 300 ppm to 2500 ppm, more preferably from about 400 ppm to about 2000 ppm, most preferably from about 500 ppm to about 1600 ppm. Step (iv) can be conducted for longer or shorter periods, depending on such factors as the degree and type of soiling of the fabrics, the nature of the soils, the nature of the fabrics, the fabric load and the like according to the needs of the user.

EXAMPLE 1

Examples of a (1) preferred liquid laundry composition which may be used both in the pretreatment process and added as a detergent into the washing machine and (2) a rinse cycle conditioner to be added during the rinse cycle. The compositions are used in a manner described after the detailed formulations.

| INGREDIENT | wt % |
|---|---|
| Liquid Cleaning Composition And Wash Pretreatment Composition | |
| Nonionic Surfactant | 0.50 |
| N-Cocoyl N-Methyl Glucamine | 1.60 |
| Anionic Surfactant | 16.00 |
| Amine Cosurfactant | 0.40 |
| Citric Acid | 2.50 |
| Fatty Acids (12–16) | 2.00 |
| Ethanol | 2.59 |
| Monoethanol amine | 0.75 |
| Sodium Formate | 0.062 |
| Propanediol | 5.08 |
| Tolulene Sulfonate | 0.36 |
| Borax Premix | 2.50 |
| Sodium Hydroxide | 2.62 |
| Fabric Care Agents | 2.70 |
| Enzymes | 0.15 |
| Balance (water, antifoaming agent, perfume, color stabilizers) | 61.67 |
| Rinse Cycle Conditioner | |
| 2,2,4-trimethyl-1,3-pentanediol | 5.30 |
| Softener Active** | 35.00 |
| Neodol Surfactant 91-8 | 4.90 |
| $MgCl_2$ | 1.75 |
| Pluronic Surfactant L35 | 1.00 |
| diethylenetriaminepenta-(methylenephosphonic acid | 0.01 |
| Perfumes and Dyes | 0.60 |
| Water | Balance |

(**softener active is N,N-di-(canolyl-oxy-ethyl)-N-methyl-N-(2-hydroxy-ethyl) ammonium methyl sulfate)

Step 1. One or more garments to be cleaned and refreshed are selected. Stains on a garment from sources such as ink, lipstick, salad dressing, collar soil and other similar sources are then identified and selected for pretreatment. For pretreatment, localized stained areas of the garment are situated over a paper towel and are treated by directly applying about 0.1 to 5 mls (depending on the size of the stain) of the liquid product of Example 1, which is gently worked into the garment using the wash pretreatment applicator. Optionally, excess liquid product may be rinsed off the stain with running cold tap water.

Step 2. The flexible wrap container is laid flat on an even surface such as a table or clothes dryer. A first garment such as a jacket is placed on the wrap. The sleeves and other extensions of the garment should be folded-in if necessary and none of the garment may lie outside the perimeter of the wrap. After the first garment has been laid on the wrap, the wrap's flaps are folded over the garment so that the entire garment is enclosed by the wrap. An additional garment may then be placed over the folded flaps following the same procedure described above and being careful that none of the garment lies outside the perimeter of the flexible wrap container.

Step 3. The wrap is then rolled up as if one were rolling up a sleeping bag. The wrap is rolled in a direction parallel to the longest edge of the wrap, starting from the edge with close proximity to the connecting means. After the bag has been rolled up, it is secured by means of one or more straps and fasteners so that the strap(s) holding the bag are pulled taut.

Step 4. The garment-containing wrap is then placed in a washing machine. Preferably two garment-containing wraps of approximately equal weight are placed in the washing machine simultaneously to insure a balanced load. The washing machine settings should be set on: medium water level (approximately 17 gallons), cold water and the most gentle agitation setting. Two capfuls of the liquid product of Example 1 (about 66 ml) are poured into the washing machine; 66 ml of the liquid product of Example 1 in 17 gallons of water means that the total concentration of liquid cleaning composition in the detergent/water solution will be about 1090 ppm. One capful of the rinse cycle conditioner (about 30 ml) may be added either through the washing machine's automatic rinse dispenser or through the use of an apparatus for dispensing a rinse cycle conditioner. If the conditioner is to be added using the apparatus, the apparatus should be placed in the washing machine at or near the start of the wash cycle. The washing machine is then started.

Step 5. When the washing machine has completed all of its cycles, the garment-containing wraps are removed from the washing machine and the garments inside the wraps are removed from the wrap. With the exception of men's ties and wool garments, one may dry the garments by placing them in a dryer and setting the dryer on air-fluff (no heat) for silk garments or the lowest possible dryer heat setting for garments made from rayon and rayon blends. Heavy weight garments should remain in the dryer for 8 to 10 minutes, while light weight garments should remain for 4 to 6 minutes. One then removes the damp garment from the dryer and may then hang the garment or lay it flat to finish drying. For men's ties and wools the dryer step is inappropriate and air drying should begin immediately after they are removed from the washing machine.

Step 6. Press or steam the garments if necessary.

What is claimed is:

1. A flexible wrap container for use in a washing machine comprising:

a flexible panel having a right edge, a left edge, a top edge, and a bottom edge;

at least one strap and a first fastening device attached to said strap for securing the wrap container in a roll-like shape;

a first flap attached to said right edge of said flexible panel;

a second flap attached to said left edge of said flexible panel, wherein said first and second flaps overlap when folded about their respective edges; and at least two connecting means located adjacent to said bottom edge of said flexible panel for attaching the flexible wrap container to a second flexible wrap container.

2. The flexible wrap container of claim 1, wherein said first flap extends adjacent to said left edge.

3. The flexible wrap container of claim 2, wherein said second flap extends adjacent to said right edge.

4. The flexible wrap container of claim 1, further comprising an attaching device securing at least one of said flaps to said flexible panel.

5. The flexible wrap container of claim 1, further comprising a second fastening device attached to said strap.

6. The flexible wrap container of claim 1, wherein each of said flaps further comprise an attaching device for securing said flap.

7. The flexible wrap container of claim 1, wherein said flexible panel is constructed from a material selected from the group consisting of woven polyester, woven nylon, or a combination thereof.

8. The flexible wrap container of claim 1 wherein the flexible wrap container at standard temperature and pressure has a density of greater than about 1 $g/cm^3$.

9. A flexible wrap container for use in a washing machine, comprising:

a flexible panel having a right edge, a left edge a top edge and a bottom edge;

at least one strap and a first fastening device attached to said strap for securing the wrap container in a roll-like shape;

a first flap attached to said right edge of said flexible panel, wherein said first flap can be folded about said right edge;

a second flap attached to said left edge of said flexible panel, wherein said second flap can be folded about the said left edge; and at least two connecting means located adjacent to said bottom edge of said flexible panel for the purpose of attaching the flexible wrap container to a second flexible wrap container.

10. The flexible wrap container of claim 9, wherein said flexible panel comprises one or more layers wherein each layer is constructed from a material selected from the group consisting of woven polyester, woven nylon or a combination thereof.

* * * * *